US012570436B2

(12) United States Patent
Holbrook

(10) Patent No.: US 12,570,436 B2
(45) Date of Patent: Mar. 10, 2026

(54) MULTI-PIECE PLASTIC TANK HAVING AN INTEGRATED CONNECTION MEANS AND A METHOD FOR IMPLEMENTING SAME

(71) Applicant: Advanced Drainage Systems, Inc., Hilliard, OH (US)

(72) Inventor: Paul R. Holbrook, Old Saybrook, CT (US)

(73) Assignee: Advanced Drainage Systems, Inc., Hilliard, OH (US)

( * ) Notice: Subject to any disclaimer, the term of this patent is extended or adjusted under 35 U.S.C. 154(b) by 6 days.

(21) Appl. No.: 18/646,445

(22) Filed: Apr. 25, 2024

(65) Prior Publication Data

US 2024/0294302 A1 Sep. 5, 2024

Related U.S. Application Data

(62) Division of application No. 17/181,324, filed on Feb. 22, 2021, now Pat. No. 11,993,417.

(60) Provisional application No. 62/979,549, filed on Feb. 21, 2020.

(51) Int. Cl.

| | |
|---|---|
| ***B65B 7/28*** | (2006.01) |
| ***B25B 27/02*** | (2006.01) |
| ***B65B 7/16*** | (2006.01) |
| ***B65D 6/00*** | (2006.01) |
| ***B65D 6/38*** | (2006.01) |

(52) U.S. Cl.

CPC ..... *B65D 11/24* (2013.01); *B65D 11/10* (2013.01); *B65D 2303/00* (2013.01); *B65D 2313/00* (2013.01)

(58) Field of Classification Search

CPC ..... B65D 11/00; B65D 11/26; B65D 7/48; B65D 7/44; B65B 7/16; B65B 7/28; B65B 27/2842; B27B 27/02; B27B 27/0092

USPC ..... 210/532.2; 53/476, 484, 485, 489; 29/238, 243.5

See application file for complete search history.

(56) References Cited

U.S. PATENT DOCUMENTS

| | | | |
|---|---|---|---|
| 1,221,789 | A | 4/1917 | Brown |
| 1,549,878 | A | 8/1925 | Immel |
| 3,048,317 | A | 8/1962 | Cochrane et al. |
| 3,243,496 | A | 3/1966 | Silverstein |
| D207,294 | S | 3/1967 | Ferm |
| 3,358,616 | A | 12/1967 | Quita |
| 3,383,004 | A | 5/1968 | Closner |
| 3,426,903 | A | 2/1969 | Olecko |

(Continued)

FOREIGN PATENT DOCUMENTS

| | | | |
|---|---|---|---|
| EP | 1557251 | A1 | 7/2005 |
| EP | 1649997 | A1 | 4/2006 |
| GB | 2369596 | A | 6/2002 |

*Primary Examiner* — Gloria R Weeks

(74) *Attorney, Agent, or Firm* — FINNEGAN, HENDERSON, FARABOW, GARRETT & DUNNER L.L.P.

(57) ABSTRACT

A multi-piece plastic tank is provided and includes a tank top section, wherein the tank top section defines a tank top opening surrounded by a top flange that extends along the length of the top flange, a tank bottom section having, wherein the tank bottom section defines a tank bottom opening surrounded by a bottom flange that extends along the length of the bottom flange, wherein the top flange and bottom flange are configured to be connected to form the multi-piece plastic tank.

14 Claims, 20 Drawing Sheets

(56) References Cited

U.S. PATENT DOCUMENTS 3,923,186 A * 12/1975 Flanders ..... B65D 45/24 220/4.07
4,040,372 A 8/1977 Flanders
4,143,193 A 3/1979 Rees
4,171,740 A 10/1979 Clement et al.
4,231,482 A 11/1980 Bogan
4,312,172 A * 1/1982 Fisher ..... B65B 7/28 53/316
4,325,823 A 4/1982 Graham
4,333,580 A * 6/1982 Sweigart, Jr. ..... E04H 5/04 220/4.07
4,335,827 A * 6/1982 Knize ..... B65D 43/0206 220/284
4,356,930 A * 11/1982 Roper ..... B65D 43/0206 206/508
4,359,167 A 11/1982 Fouss et al.
4,646,409 A * 3/1987 DeCasper ..... B44D 3/00 29/268
4,763,393 A * 8/1988 Gee ..... B25B 27/00 81/488
4,955,495 A 9/1990 Ruebesam
5,071,021 A 12/1991 McDougall
5,076,456 A * 12/1991 Geyer ..... B65D 90/105 220/634
5,162,083 A 11/1992 Forbes
5,220,823 A 6/1993 Berg et al.
5,321,873 A * 6/1994 Goria ..... A61G 17/0136 27/35
5,361,930 A 11/1994 Perry
5,406,759 A 4/1995 DeRosa et al.
5,423,447 A 6/1995 Youngs
5,470,515 A 11/1995 Grimm et al.
5,487,604 A 1/1996 Moran
5,716,163 A 2/1998 Nichols et al.
5,776,303 A * 7/1998 Stahlecker ..... B65B 61/184 53/329
5,878,907 A 3/1999 Graf
6,170,201 B1 1/2001 Mason et al.
6,227,396 B1 5/2001 Small
6,261,490 B1 7/2001 Kliene
6,280,614 B1 8/2001 Berg et al.
6,282,763 B1 * 9/2001 Goria ..... E04H 13/00 27/35
6,305,410 B1 10/2001 Cook
6,341,410 B1 * 1/2002 Armellini ..... B25B 27/0092 29/235
6,513,343 B2 2/2003 Pahl
6,558,535 B2 5/2003 Berg et al.
6,698,610 B2 3/2004 Berg et al.
6,698,975 B1 3/2004 Benecke
6,736,283 B1 * 5/2004 Santamaria ..... B65D 7/36 220/619
6,786,689 B2 9/2004 Dorris
D498,815 S 11/2004 Greer
6,852,788 B2 2/2005 Stevenson et al.
6,915,553 B2 * 7/2005 Turner ..... B21D 51/2653 413/4
6,962,265 B1 11/2005 Zhang
7,144,506 B2 12/2006 Lombardi, II
7,178,686 B2 2/2007 Bolzer et al.
7,572,372 B2 8/2009 Graf
7,690,172 B2 * 4/2010 Denis ..... B65B 59/003 53/367
7,854,338 B2 12/2010 Graf
8,070,005 B1 12/2011 Kruger et al.
8,151,999 B1 * 4/2012 Moore, Jr. ..... E03F 11/00 210/532.2
8,181,326 B2 * 5/2012 Silliman ..... B23P 19/047 29/243.517
8,287,220 B2 * 10/2012 Oberholzer ..... B21D 51/443 220/254.1
8,740,005 B1 6/2014 Holbrook et al.
8,800,252 B2 * 8/2014 Vodonos ..... B65B 51/18 53/316
8,857,641 B1 10/2014 Moore, Jr. et al.
8,984,846 B2 * 3/2015 Klein ..... B65B 7/28 53/488
9,260,854 B1 2/2016 Moore, Jr. et al.
10,266,286 B2 * 4/2019 Resh ..... B65B 5/04
10,392,165 B2 * 8/2019 DeCarlo ..... B65D 43/169
10,640,407 B1 5/2020 Holbrook
11,524,819 B2 * 12/2022 Morris ..... B65D 45/32
11,993,417 B1 * 5/2024 Holbrook ..... B65D 11/10
12,343,848 B2 * 7/2025 Hurst ..... B25B 27/02
2001/0019026 A1 9/2001 Berg et al.
2002/0092852 A1 * 7/2002 Stewart ..... B65B 7/168 220/258.1
2002/0153380 A1 10/2002 Wade
2003/0101692 A1 * 6/2003 Behnke ..... B65B 11/50 53/485
2004/0261343 A1 12/2004 Koteskey
2005/0077301 A1 4/2005 Bolzer et al.
2006/0228222 A1 10/2006 Pohler
2007/0251879 A1 11/2007 Batten
2008/0120944 A1 * 5/2008 Rimondi ..... B65B 31/043 53/477
2009/0255871 A1 10/2009 Davis
2009/0314791 A1 12/2009 Hartley et al.
2010/0012557 A1 1/2010 Chaffee
2010/0270220 A1 10/2010 Juhere
2011/0229288 A1 * 9/2011 Sanz ..... B21D 51/32 413/39
2011/0293371 A1 12/2011 Moore et al.
2012/0005994 A1 * 1/2012 Tidball ..... B65D 43/162 53/484
2013/0160406 A1 * 6/2013 Johnston ..... B65B 7/26 220/268
2014/0290020 A1 * 10/2014 Radhakrishnan ... B25B 27/0092 29/252

* cited by examiner

Gear feature on this pulley provides "walking" action around flange as lever is turned

MULTI-PIECE PLASTIC TANK HAVING AN INTEGRATED CONNECTION MEANS AND A METHOD FOR IMPLEMENTING SAME

CROSS-REFERENCE TO RELATED APPLICATIONS

This application is a divisional of U.S. patent application Ser. No. 17/181,324, filed Feb. 22, 2021, which claims the benefit of priority of the filing date of U.S. Provisional Patent Application Ser. No. 62/979,549 entitled "Multi-Piece Plastic Tank Having an Integrated Connection Means and a Method for Implementing Same," filed on Feb. 21, 2020 the contents of which is incorporated herein by reference in its entirety.

FIELD OF THE INVENTION

The present invention relates generally to multi-piece tanks made of molded plastic, and more particularly to multi-piece molded plastic tanks that are useful for storing water and other liquids, wherein the multi-piece molded plastic tanks are configured to securely connect together without external fasteners.

BACKGROUND OF THE INVENTION

Unpressurized above-ground and below-ground tanks are well known and are commonly used to store water and other liquids, which from time to time may be drawn from the tanks by means of a pump or gravity flow. This is particularly common in areas where the water supply is intermittent and/or where the instantaneous demand exceeds the available flow rate of the source of supply. Additionally, it is desirous to be able to seal these tanks when certain liquids, such as potable water, are contained within the tanks. It should be appreciated that the size of these tanks are typically responsive to the particular need for the tank. For example, water storage tanks that are associated with dwellings or other smaller buildings may have a capacity of between 500 liters and 1000 liters. One type of tank that is used for this purpose is a squat cylindrical shaped tank which is popular due to its compactness and ease of manufacture. Although these tanks have good structural integrity, they are bulky thereby causing storage and the cost of shipping from factory to point of use to be high. For example, a representative 500-liter tank might be about 100 cm high and about 100 cm in diameter, wherein this type of tank may be made as a one-piece plastic tank by blow molding or rotational molding.

Other types of tanks, such as those that will be oriented as vertical cylinders, typically have a larger volume capacity which may range from about 9,500 liters to about 11,000 liters, or more (Very Large Tanks-VLT's). A representative type of this tank may be about 8 to 10 feet (2.4 to 3.1 meter) high and have a diameter of about 8 feet (2.4 meters). Additionally, this type of tank may have a basic wall thickness of between about 0.19 to 0.4 inches (4.8 to 10 mm) and they may weigh between about 250 to 400 pounds (114 to 180 kilograms). It should be appreciated that, while some (smaller sized tanks) of these type of tanks may be blow molded or rotational molded, the larger size tanks, such as the VLTs, are typically multi-piece tanks that are assembled and connected together at the point of use (i.e. on-site) via welding and/or separate clips (i.e. other retention articles).

This is undesirable for at least two reasons. First, because these multi-piece tanks have to be connected together at the point of use (i.e., on-site), this requires the installers to carry a large number of tools, clips and/or other articles that are necessary to securely connect the pieces of the tank together. Second, because these multi-piece tanks have to be connected together at the point of use (i.e., on-site), quality control is very difficult to ensure.

SUMMARY OF THE INVENTION

A multi-piece plastic tank assembly is provided and includes a tank top section having tank top side walls and tank top end walls which define a tank top cavity, wherein the tank top section defines a tank top opening surrounded by a top opening edge and communicated with the tank top cavity, and wherein the top opening edge includes a top flange that extends along the length of the top opening edge and defines a top flange mounting interface cavity. The multi-piece plastic tank assembly also includes a tank bottom section having tank bottom side walls and tank bottom end walls which define a tank bottom cavity, wherein the tank bottom section defines a tank bottom opening surrounded by a bottom opening edge and communicated with the tank bottom cavity, and wherein the bottom opening edge includes a bottom flange that extends along the length of the bottom opening edge and defines a bottom flange mounting interface structure. It should be appreciated that at least one of the top flange includes a top flange jig interface structure and the bottom flange includes a bottom flange jig interface structure, wherein the top opening edge and bottom opening edge are configured to be connected to form the multi-piece plastic tank such that the tank top cavity is adjacent to the tank bottom cavity to form a tank interior cavity, and such that the bottom flange mounting interface structure is securely contained within the top flange mounting interface cavity.

A multi-piece plastic tank is provided and includes a tank top section having tank top side walls and tank top end walls which define a tank top cavity, wherein the tank top section defines a tank top opening surrounded by a top opening edge and communicated with the tank top cavity, and wherein the top opening edge includes a top flange that extends along the length of the top opening edge and defines a top flange mounting interface cavity. Moreover, the multi-piece plastic tank includes a tank bottom section having tank bottom side walls and tank bottom end walls which define a tank bottom cavity, wherein the tank bottom section defines a tank bottom opening surrounded by a bottom opening edge and communicated with the tank bottom cavity, and wherein the bottom opening edge includes a bottom flange that extends along the length of the bottom opening edge and defines a bottom flange mounting interface structure. It should be appreciated that the top opening edge and bottom opening edge are configured to be connected to form the multi-piece plastic tank such that the tank top cavity is adjacent to the tank bottom cavity to form a tank interior cavity, and such that the bottom flange mounting interface structure is securely contained within the top flange mounting interface cavity.

A method for associating a jig having a jig engagement structure with a first half tank structure and with a second half tank structure to form a multi-piece molded plastic tank is provided, wherein the first half tank structure includes a first half tank flange and wherein the second half tank structure includes a second half tank flange. The method includes associating the first half tank structure with the second half tank structure such that the first half tank flange is aligned with the second half tank flange, wherein at least one of the first half tank flange includes a first jig structure and the second half tank includes a second jig structure. The method further includes associating the jig with first half tank flange and the second half tank flange, such that the jig engagement structure is associated with at least one of the first jig structure and the second jig structure and operating the jig to cause the jig to traverse the first half tank flange and the second half tank flange such that the first half tank flange becomes securely associated with second half tank flange. Furthermore the method includes disassociating the jig from the first half tank flange and the second half tank flange.

BRIEF DESCRIPTION OF THE DRAWINGS

The foregoing and other features and advantages of the present invention should be more fully understood from the accompanying detailed description of illustrative embodiments taken in conjunction with the following Figures in which like elements are numbered alike in the several Figures.

DETAILED DESCRIPTION

As discussed hereinafter and in accordance with the present invention, a molded plastic tank which is constructed from multiple tank pieces is provided along with an article and method for securely connecting the multiple tank pieces together to form the tank.

Figure 1:
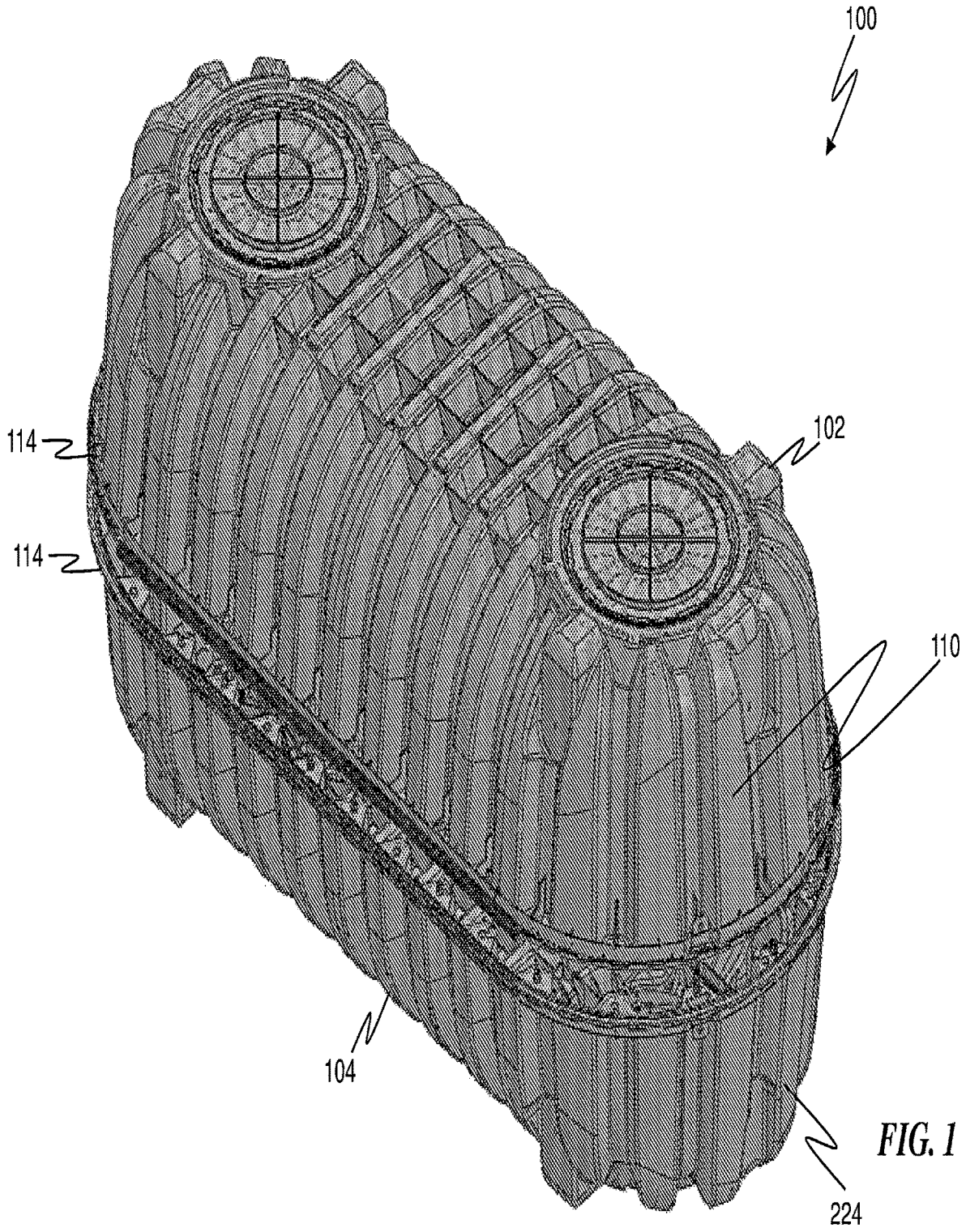
FIG. 1 front side perspective view of a storage tank, in accordance with one embodiment of the present invention.
Figure 2:
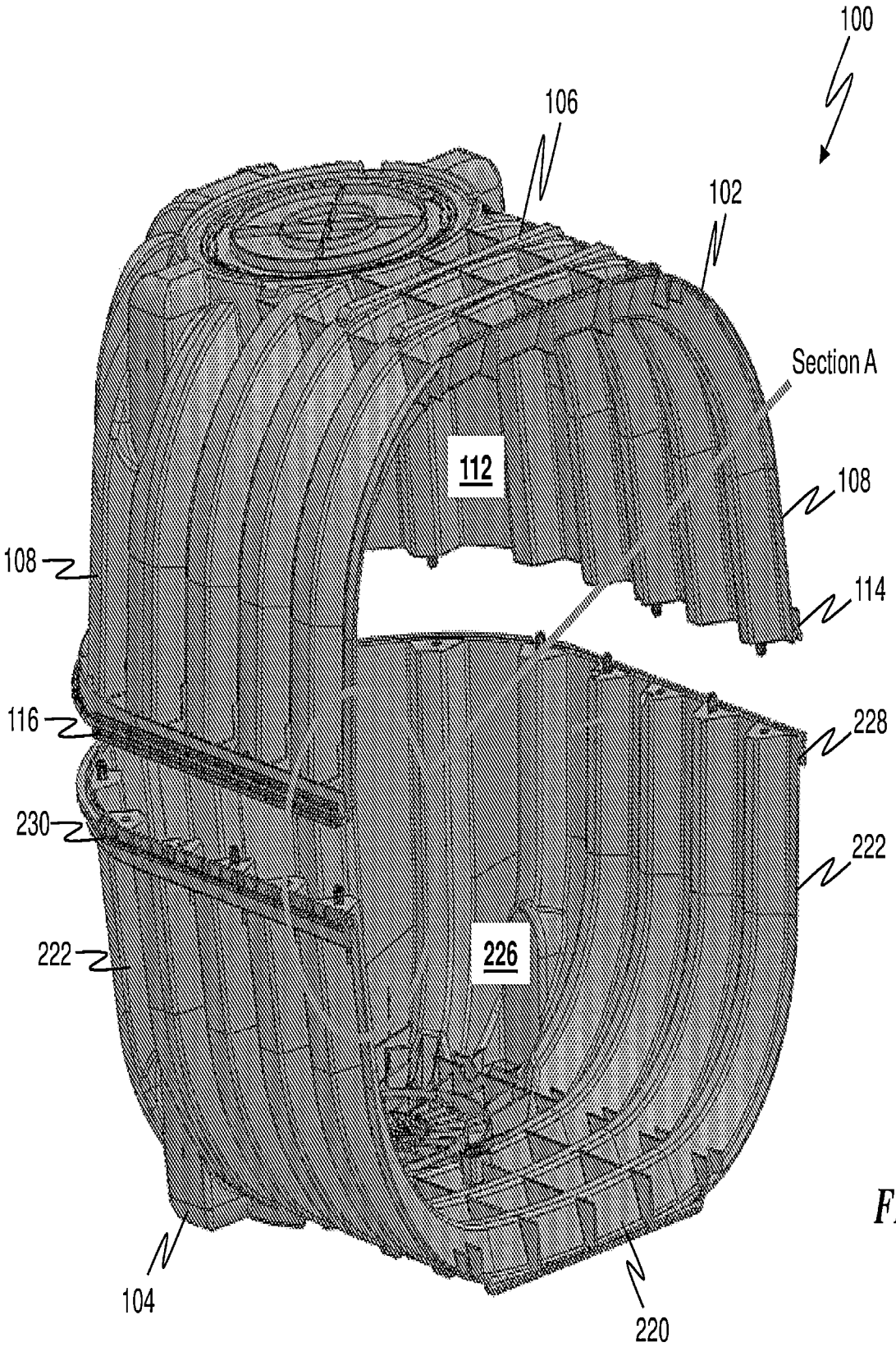
FIG. 2 is a front side perspective view of a section of the storage tank of FIG. 1.

Referring to FIG. 1 and FIG. 2, a multi-piece molded plastic tank 100 is shown having a first half tank structure (i.e., first half tank) 102 and a second half tank structure (i.e., second half tank) 104, in accordance with one embodiment of the invention. The first half tank 102 may be arcuate in shape and includes a first half tank base 106, first half tank side walls 108 and first half tank end walls 110, wherein the first half tank base 106, first half tank side walls 108 and first half tank end walls 110 define a first half tank cavity 112. Additionally, it should be appreciated that the first half tank side walls 108 and first half tank end walls 110 extend upwardly (or downwardly depending on the orientation of the first half tank structure 102) from the first half tank base 106 to form a first half tank flange 116 which extends around the circumference of the first half tank 102.

Figure 3:
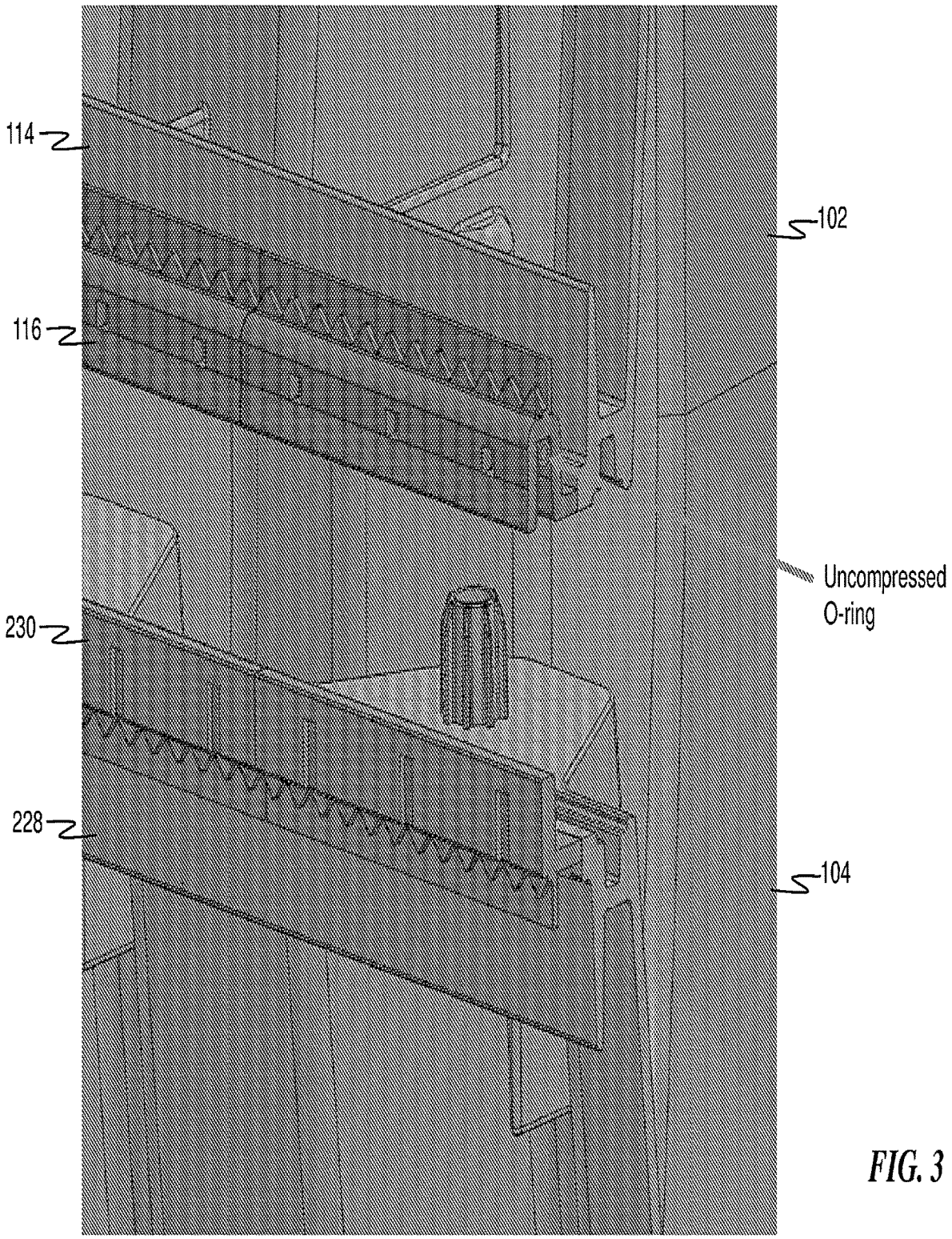
FIG. 3 is a close-up, side view of the flange of the first and second half sections of the storage tank of FIG. 2.
Figure 4:
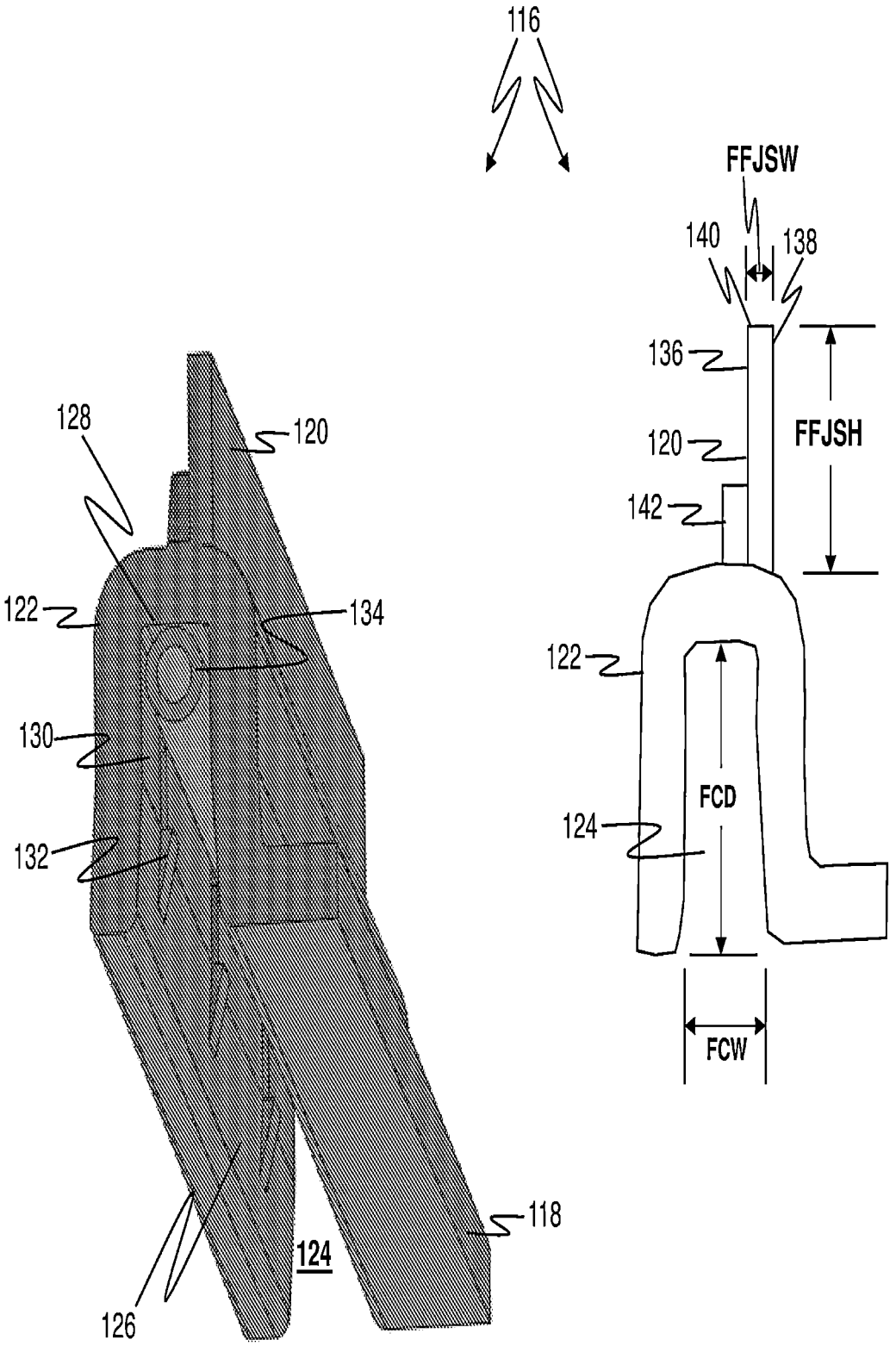
FIG. 4 is a bottom up, end view of the first half tank flange of the storage tank of FIG. 2.

Referring to FIG. 3 and FIG. 4, the first half tank flange 116 includes a first flange mounting structure 118, a first flange jig structure 120 and a first flange engagement structure 122, wherein the first flange engagement structure 122 defines a flange cavity 124 which includes a flange cavity opening 126, a flange inner top 128 and flange inner sidewalls 130. Moreover, it is contemplated that the flange cavity 124 extends along the length of the first half tank flange 116 and includes a flange cavity width FCW and a flange cavity depth FCD. Additionally, the first half tank flange 116 includes one or more flange protrusions 132 located on one or more of the flange inner sidewalls 130, wherein the one or more flange protrusions 132 extend out of the flange inner sidewalls 130 and into the flange cavity 124. It should be appreciated that although the one or more flange protrusions 132 are shown as being angular in shape, in other embodiments, the one or more flange protrusions 132 may be any shape suitable to the desired end purpose.

Furthermore, the first half tank flange 116 also includes a sealing article 134, such as an O-ring, which is disposed within the flange cavity 124 to be located proximate the flange inner top 128, wherein the O-ring 134 may be constructed from a rubber and/or plastic material to be sealingly and flexibly resilient. Additionally, the first flange jig structure 120 extends upwardly from the top of the first flange engagement structure 122 and includes a first flange jig structure outer sidewall 136, a first flange jig structure inner sidewall 138 and a first flange jig structure top 140. Moreover, the first flange jig structure 120 extends along the length of the first flange engagement structure 122 and includes a first flange jig structure width FFJSW and a first flange jig structure height FFJSH. It should be appreciated that the first flange jig structure 120 includes a first jig structure 142 which extends out of and along the length of the first flange jig structure outer sidewall 136 and/or the top of the first flange engagement structure 122.

Referring again to FIG. 1 and FIG. 2, the second half tank 104 is also arcuate in shape and includes a second half tank base 220, second half tank side walls 222 and second half tank end walls 224, wherein the second half tank base 220, second half tank side walls 222 and second half tank end walls 224 define a second half tank cavity 226. Additionally, it should be appreciated that the second half tank side walls 222 and second half tank end walls 224 extend upwardly from the second half tank base 220 to form a second half tank flange 230, wherein the second half tank flange 230 also extends around the circumference of the second half tank 104.

Figure 5:
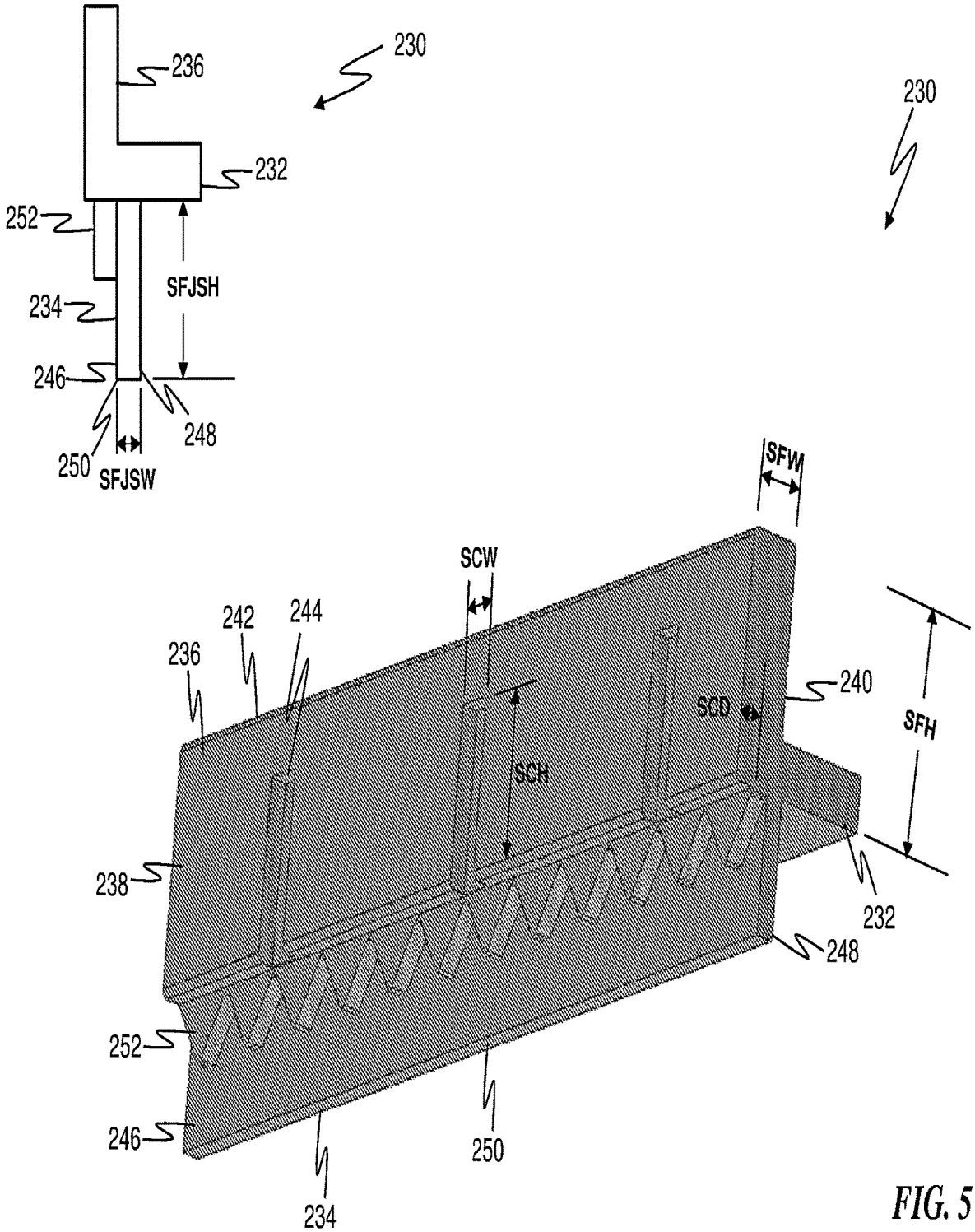
FIG. 5 is a bottom up, side view of the second half tank flange of the storage tank of FIG. 2.

Referring to FIG. 3 and FIG. 5, the second half tank flange 230 includes a second flange mounting structure 232, a second flange jig structure 234 and a second flange engagement structure 236. The second flange engagement structure 236 extends upwardly from the second flange mounting structure 232 and includes a second flange engagement structure outer sidewall 238, a second flange engagement structure inner sidewall 240 and a second flange engagement structure top 242. It should be appreciated that the second flange engagement structure 236 extends along the length of the second half tank flange 230 and includes a second flange width SFW and a second flange height SFH. Moreover, the second flange engagement structure 236 defines one or more flange side cavities 244 located on the second flange engagement structure outer sidewall 238, wherein the one or more flange side cavities 244 include a side cavity height SCH, a side cavity width SCW and a side cavity depth SCD. It should be appreciated that although the one or more flange side cavities 244 are shown as being substantially rectangular in shape, in other embodiments, the one or more flange side cavities 244 may be any shape suitable to the desired end purpose.

Additionally, the second flange jig structure 234 extends downwardly from the second flange mounting structure 232 and includes a second flange jig structure outer sidewall 246, a second flange jig structure inner sidewall 248 and a first flange jig structure bottom 250. Moreover, the second flange jig structure 234 extends along the length of the second flange mounting structure 232 and includes a second flange jig structure width SFJSW and a second flange jig structure height SFJSH. It should be appreciated that, in accordance with one embodiment of the invention, the second flange jig structure 234 includes a second jig structure 252 which extends out of and along the length of the second flange jig structure outer sidewall 246, wherein the second jig structure 252 has a substantially sawtooth shape.

Figure 6:
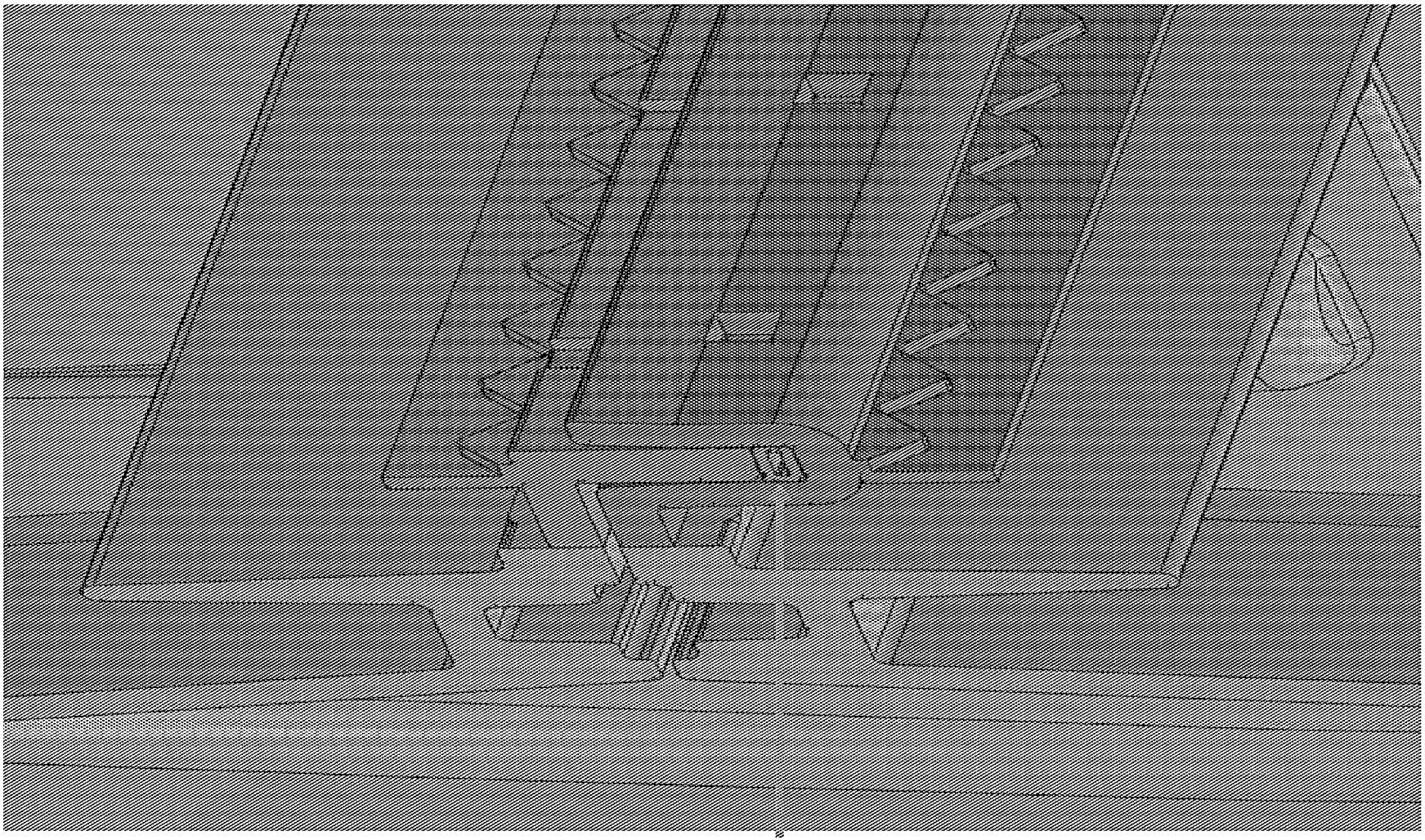
FIG. 6 is an end side view of the first and second half tank sections of FIG. 2 connected together.
Figure 7:
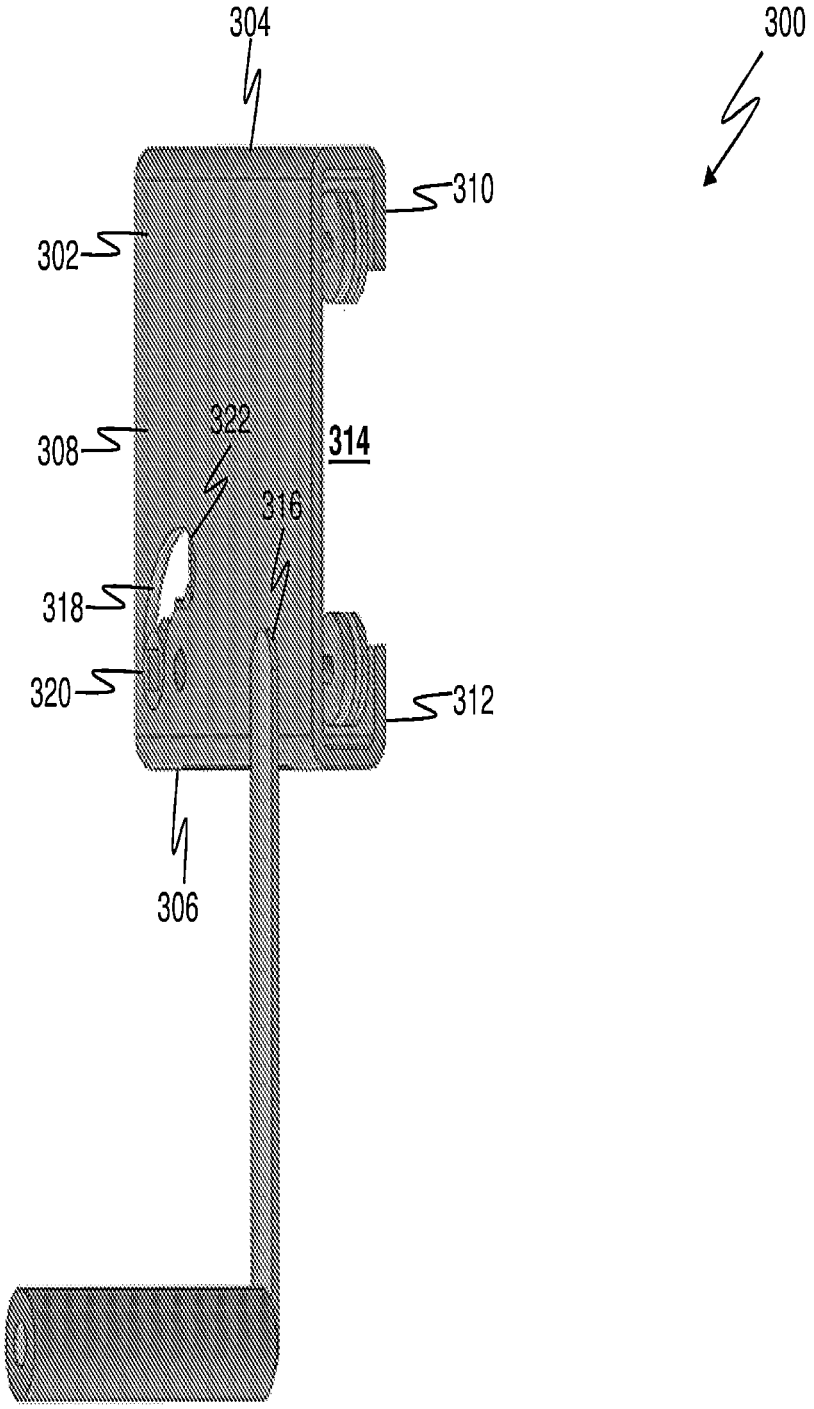
FIG. 7 is a rear view of a jig used to connect the first and second half tank sections of FIG. 2 together, in accordance with one embodiment of the invention.
Figure 8:
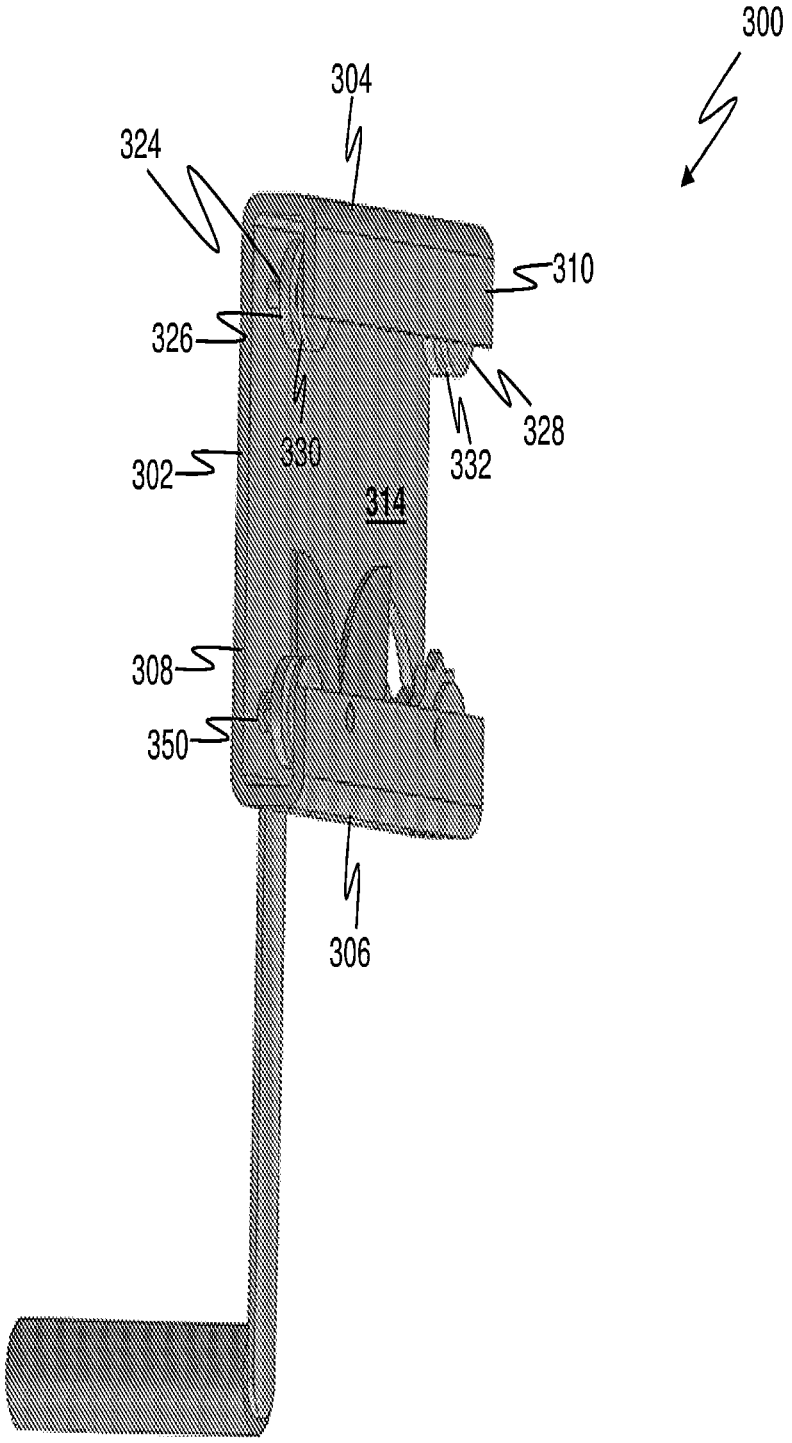
FIG. 8 is a front view of the jig of FIG. 7.
Figure 9A:
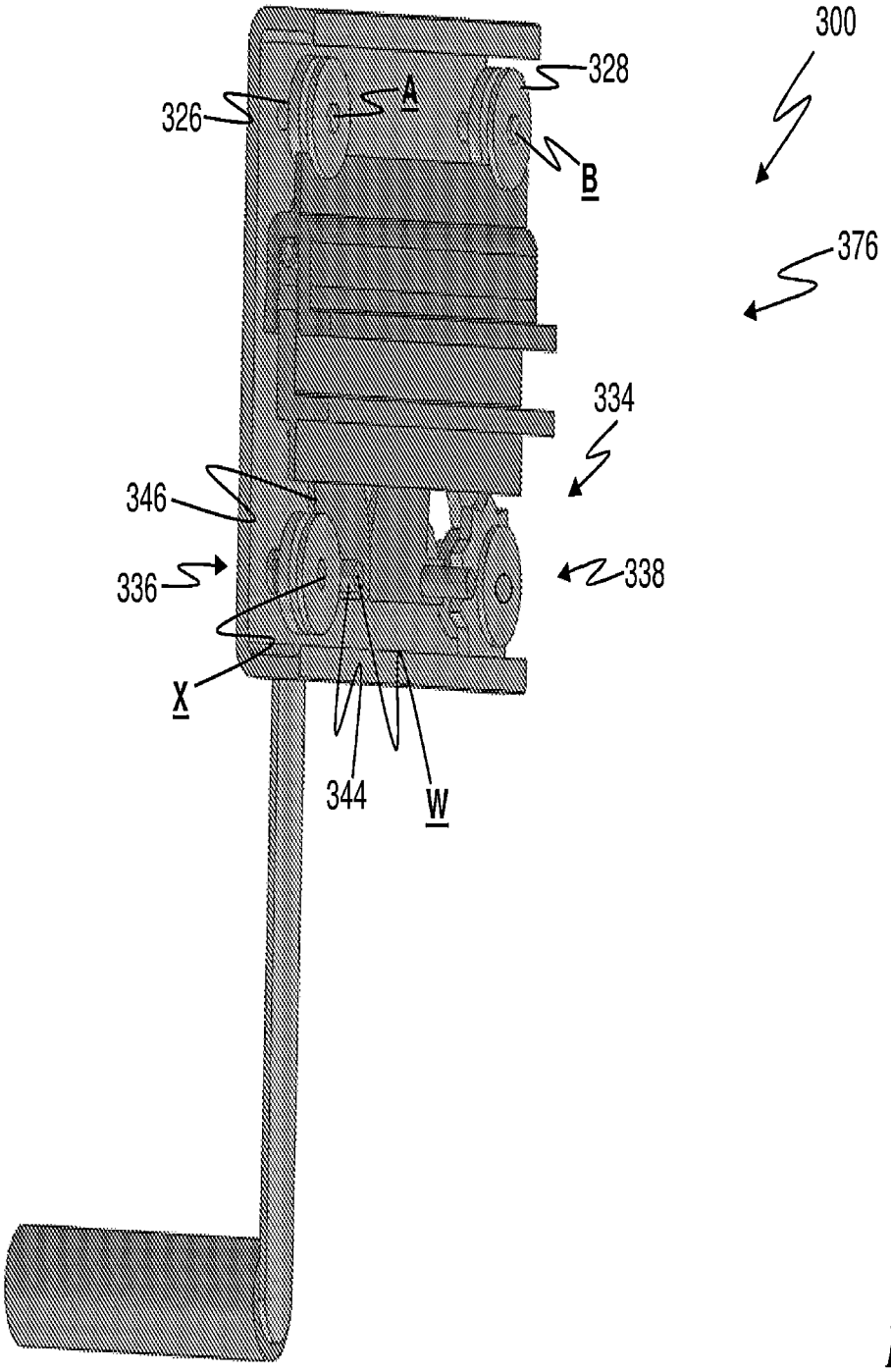
FIG. 9A is a front view of the jig of FIG. 7, with the upper and lower lips removed and the lower rail system in the disengaged configuration, in one embodiment of the invention.
Figure 9B:
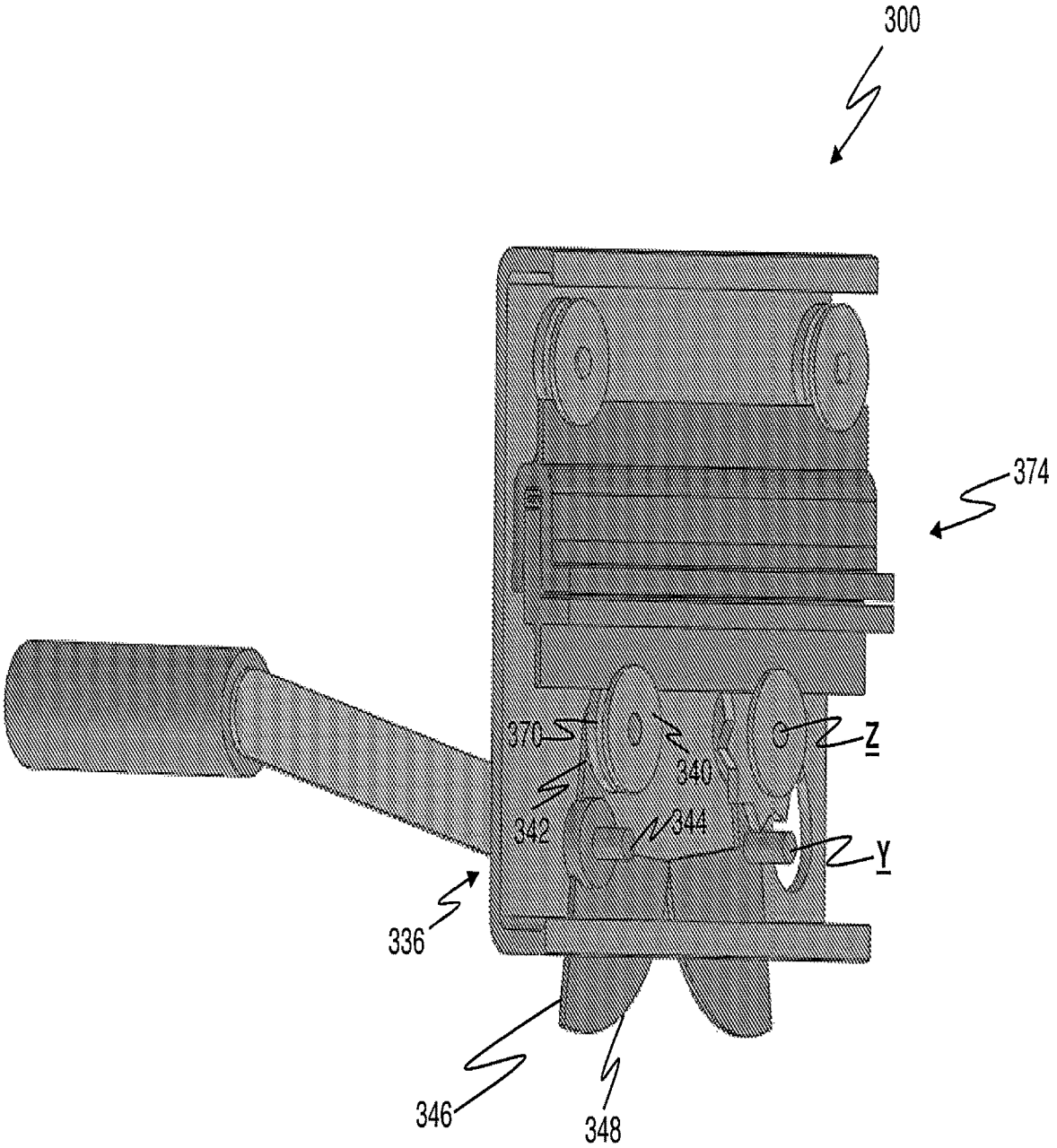
FIG. 9B is a front view of the jig of FIG. 7, with the upper and lower lips removed and the lower rail system in the engaged configuration, in one embodiment of the invention.
Figure 9C:
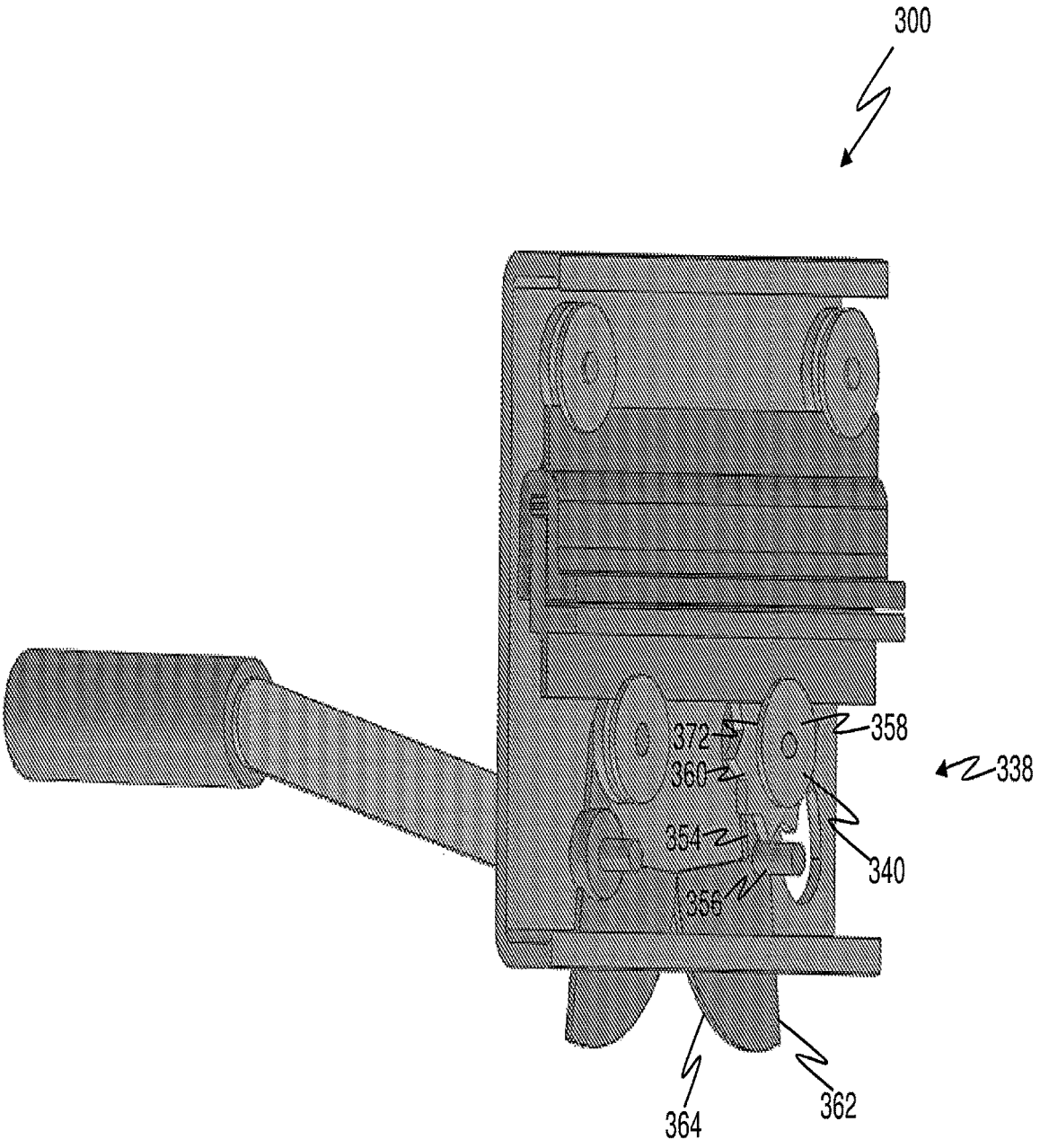
FIG. 9C is a front view of the jig of FIG. 7, with the upper and lower lips removed and the lower rail system in the engaged configuration, in one embodiment of the invention.
Figure 10:
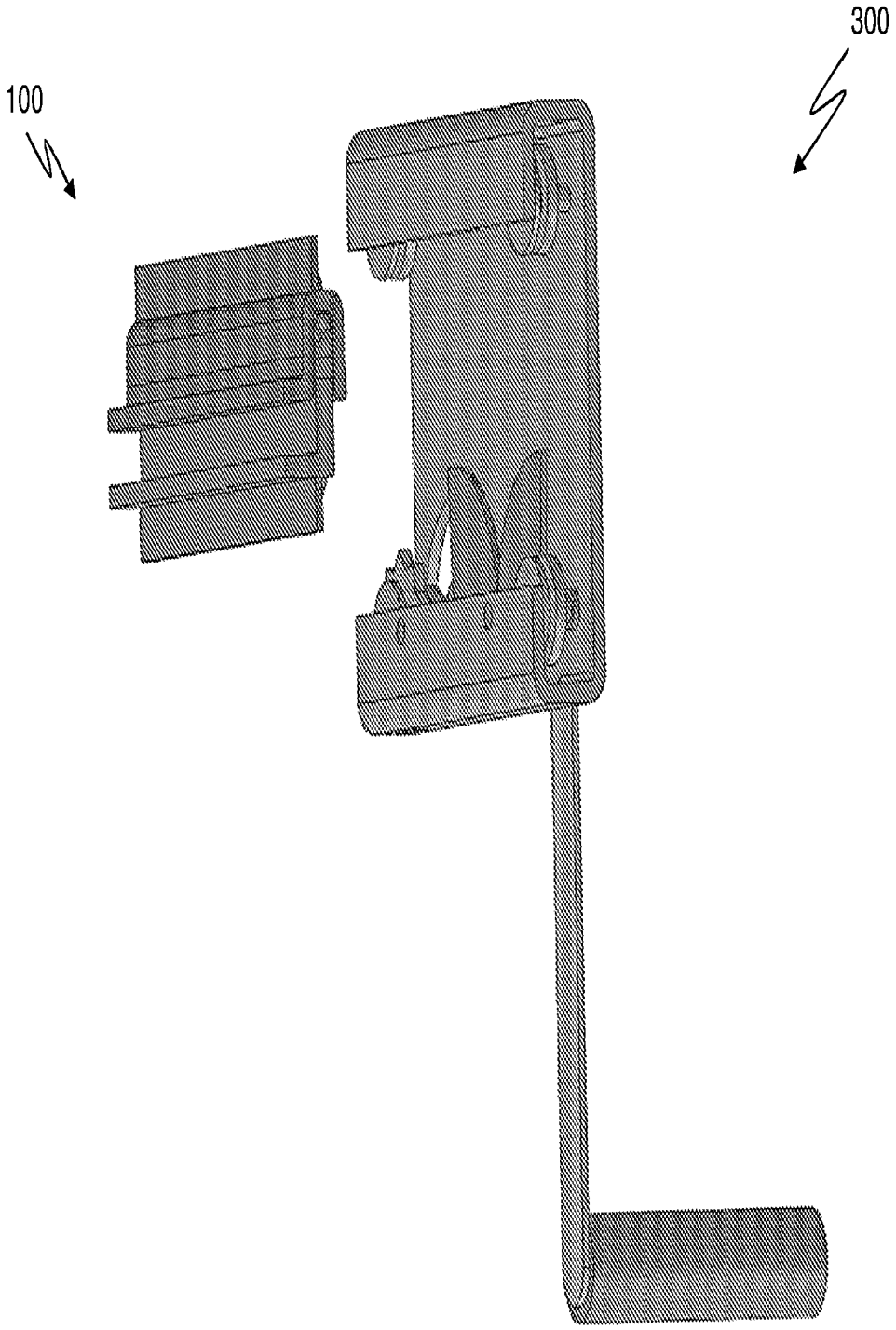
FIG. 10 is a front view of a portion of the first and second half tank sections of FIG. 2 with of the jig of FIG. 7, in accordance with one embodiment of the invention.
Figure 11:
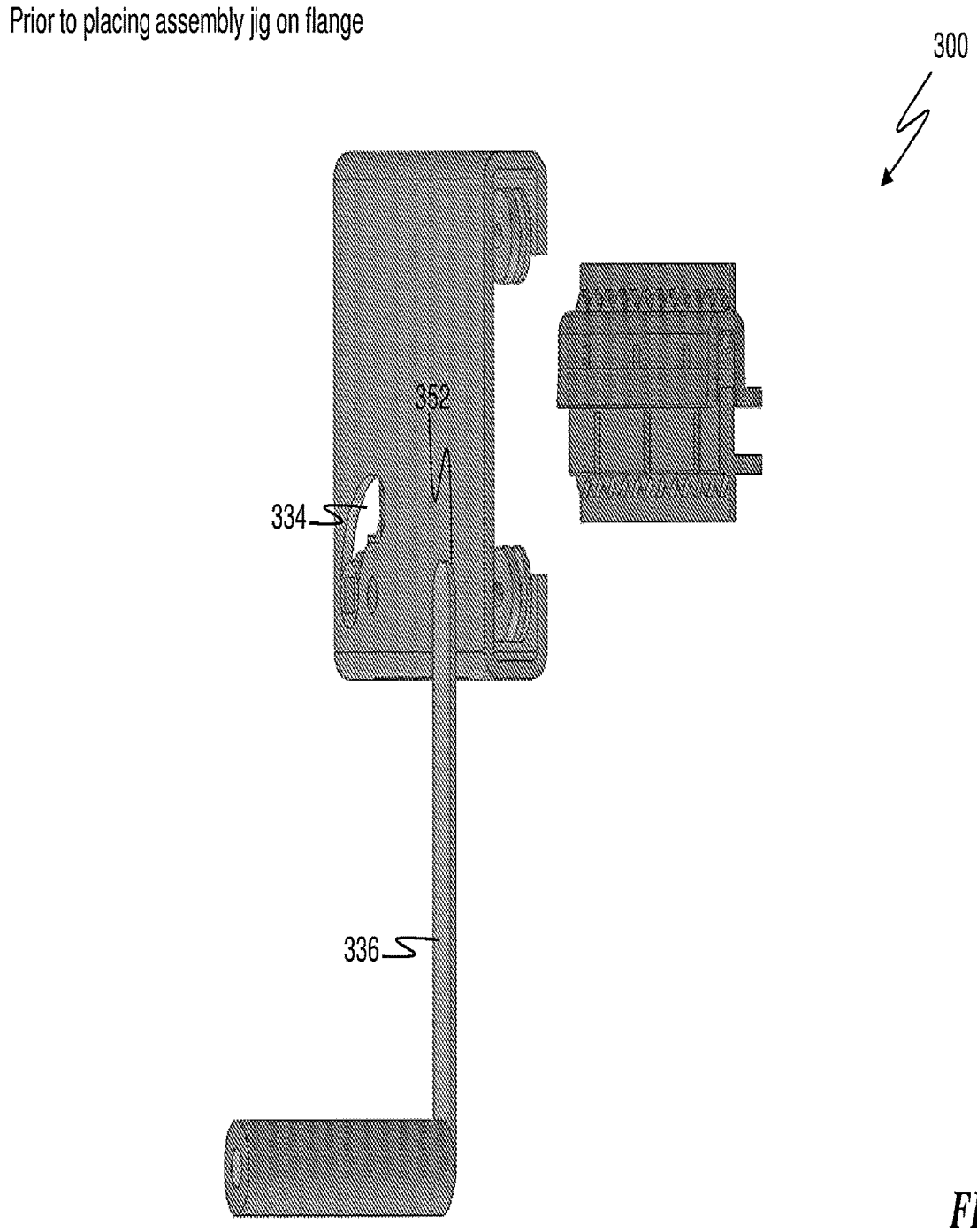
FIG. 11 is a rear view of a portion of the first and second half tank sections of FIG. 2 with of the jig of FIG. 7, in accordance with one embodiment of the invention.

Referring to FIG. 6, it should be appreciated that the first half tank 102 and the second half tank 104 are configured as half tanks that, when assembled together, form the complete multi-piece molded plastic tank 100. Referring again to FIG. 2, the first half tank 102 is positioned relative to the second half tank 104 such the first half tank lip 114 and the second half tank lip 228 are aligned with each other and are located proximate to each other. Additionally, the first half tank flange 116 and the second half tank flange 230 will be aligned such that the second flange engagement structure 236 will be located proximate to the flange cavity 124 and aligned with the flange cavity opening 126. The first half tank 102 is compressed onto the second half tank 104 such that the second flange engagement structure 236 is contained within the flange cavity 124 to compress the O-ring 134. It should be appreciated that the one or more flange protrusions 132 located on the one or more of the flange inner sidewalls 130 are configured to be aligned with the one or more flange side cavities 244 such that when the second flange engagement structure 236 is contained within the flange cavity 124, the one or more flange protrusions 132 are contained with the one or more flange side cavities 244. This advantageously allows the first half tank 102 and second half tank 104 to be securely and sealingly connected together.

Referring to FIG. 7 through FIG. 17, a jig 300 for facilitating the connection of the first half tank 102 and second half tank 104 is provided, in accordance with one embodiment of the invention. The jig 300 includes a jig containment structure 302 having a containment structure top 304, a containment structure bottom 306, a containment structure rear 308, a containment structure front top lip 310 and a containment structure front bottom lip 312, wherein the jig containment structure 302 defines a jig cavity 314. The jig containment structure rear 308 defines a jig first cavity 316 and a jig second cavity 318, wherein the jig second cavity 318 includes a jig second cavity first end 320 and a jig second cavity second end 322. The jig 300 includes an upper rail system 324 located within the jig cavity 314 to be proximate the containment structure top 304, wherein the upper rail system 324 includes a first rail roller 326 and a second rail roller 328. The first rail roller 326 and second rail roller 328 are rotatably connected to the containment structure rear 308, wherein the first rail roller 326 is rotatable about a first roller axis A and the second rail roller 328 is rotatable about a second roller axis B. It should be appreciated that the first rail roller 326 includes a first roller channel 330 and the second rail roller 328 includes a second roller channel 332, both of which are sized and shaped to contain the first flange jig structure 120.

The jig 300 further includes a lower rail system 334 located within the jig cavity 314 to be proximate the containment structure bottom 306, wherein the lower rail system 334 includes a first disc section 336 and a second disc section 338. The first disc section 336 includes a third rail roller 340, a first disc roller arm 342, a first disc shaft 344 and a first disc plate 346 having a first plate curved section 348, wherein the first disc shaft 344 is rotatably connected to the jig containment structure 302 to rotate about an axis W. It should be appreciated that the first disc shaft 344 includes a first disc shaft end 350 defining a first disc shaft end keyed opening 352, wherein the first disc shaft end 350 is located proximate the jig first cavity 316 to allow access to the first disc shaft end keyed opening 352 via the jig first cavity 316. The third rail roller 330 is rotatably connected to the first disc roller arm 342 to rotate about an axis X.

The second disc section 338 includes a second disc roller arm 354, a second disc shaft 356, a fourth rail roller 358 having an engagement structure 360, and a second disc plate 362 having a second plate curved section 364. It should be appreciated that the second disc shaft 356 is rotatably connected to the jig containment structure 302 to rotate about an axis Y and the fourth rail roller 358 is rotatably connected to the second disc roller arm 352 to rotate about an axis Z. The fourth rail roller 358 includes a fourth rail roller end 366 defining a fourth rail roller end keyed opening 368, wherein the fourth rail roller end 366 is located within the jig second cavity 318 to allow access to the fourth rail roller end keyed opening 368 via the jig second cavity 318. It should be appreciated that the third rail roller 340 includes a third roller channel 370 and the fourth rail roller 358 includes a fourth roller channel 372, both of which are sized and shaped to contain the second flange jig structure 234. It should be further appreciated that the first disc plate 346 and the second disc plate 362 are configured such that the first plate curved section 348 is adjacent to and in contact with the second plate curved section 364 such that rotation of the first plate curved section 348 causes rotation of the second plate curved section 364. It should be further appreciated that the lower rail system 334 is configurable between an engaged configuration 374 and a disengaged configuration 376.

It should be appreciated that in one embodiment of the invention, the engagement structure 360 is configured (sized and shaped) to engage with the second jig structure 252, to cause the jig 300 to traverse the length of the first half tank flange 116 and the second half tank flange 230 to cause the first half tank flange 116 and the second half tank flange 230 to be compressed together. It is contemplated that in another embodiment, the engagement structure 360 and the second jig structure 252 may be configured into any configuration suitable to the desired end purpose, where the engagement structure 360 and the second jig structure 252 cooperate and/or engage each other, such as, for example, a rack and pinion configuration. Additionally, in still other embodiments, it is contemplated that the first half tank flange 116 and/or the second half tank flange 230 may or may not include the first jig structure 142 or the second jig structure 252, respectfully. Additionally, it is contemplated that in still other embodiments, the jig 300 may be configured to engage with the first jig structure 142 and/or the second jig structure 252, as desired.

Accordingly, if the first half tank flange 116 includes the first jig structure 142 and the second half tank flange 230 includes the second jig structure 252, the jig 300 may be configured to engage with the first half tank flange 116 or the second half tank flange 230 or both the first half tank flange 116 and the second half tank flange 230, as desired. If the first half tank flange 116 includes the first jig structure 142 and the second half tank flange 230 does not include the second jig structure 252, then the jig 300 may be configured to only engage with the first jig structure 142. Similarly, if the second half tank flange 230 includes the second jig structure 252 and the first half tank flange 116 does not include the first jig structure 142, then the jig 300 may be configured to only engage with the second jig structure 252.

Referring again to FIG. 15 and FIG. 16, an actuation handle 378 is provided and includes a gripping portion 380 and a handle interface portion 382, wherein the handle interface portion 382 is sized and shaped to engage with the first disc shaft end keyed opening 352 and the fourth rail roller end keyed opening 368. It should be appreciated that although in one embodiment, the handle interface portion 382 is a male structure and the first disc shaft end keyed opening 352 and the fourth rail roller end keyed opening 368 are female structures, it is contemplated that in other embodiments the handle interface portion 382 may be a female structure and the first disc shaft end keyed opening 352 and the fourth rail roller end keyed opening 368 may be female structures.

Figure 12:
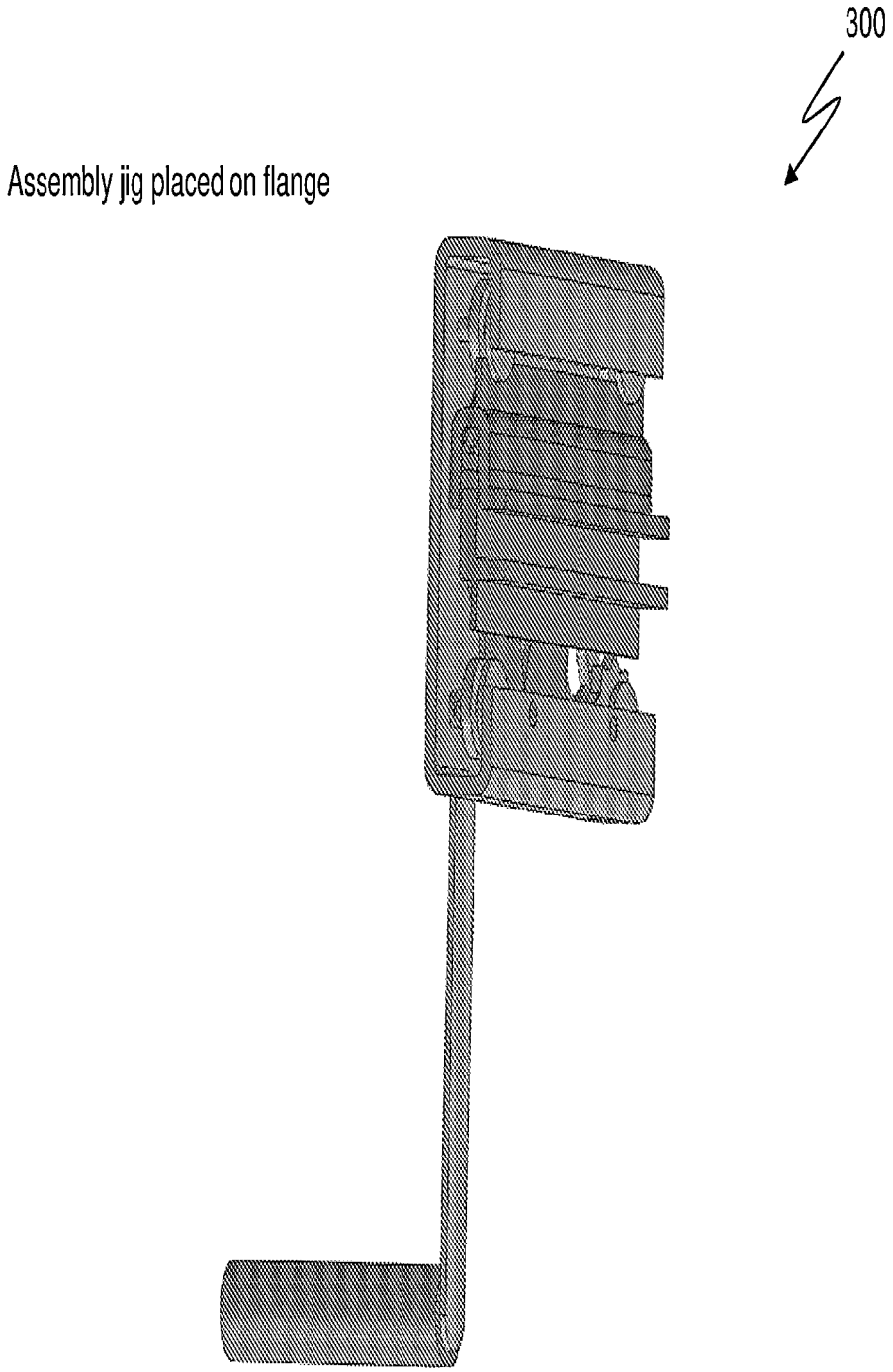
FIG. 12 is a front view of the jig of FIG. 7 associated with a portion of the first and second half tank sections of FIG. 2 with the lower rail system in the disengaged configuration, in accordance with one embodiment of the invention.
Figure 13:
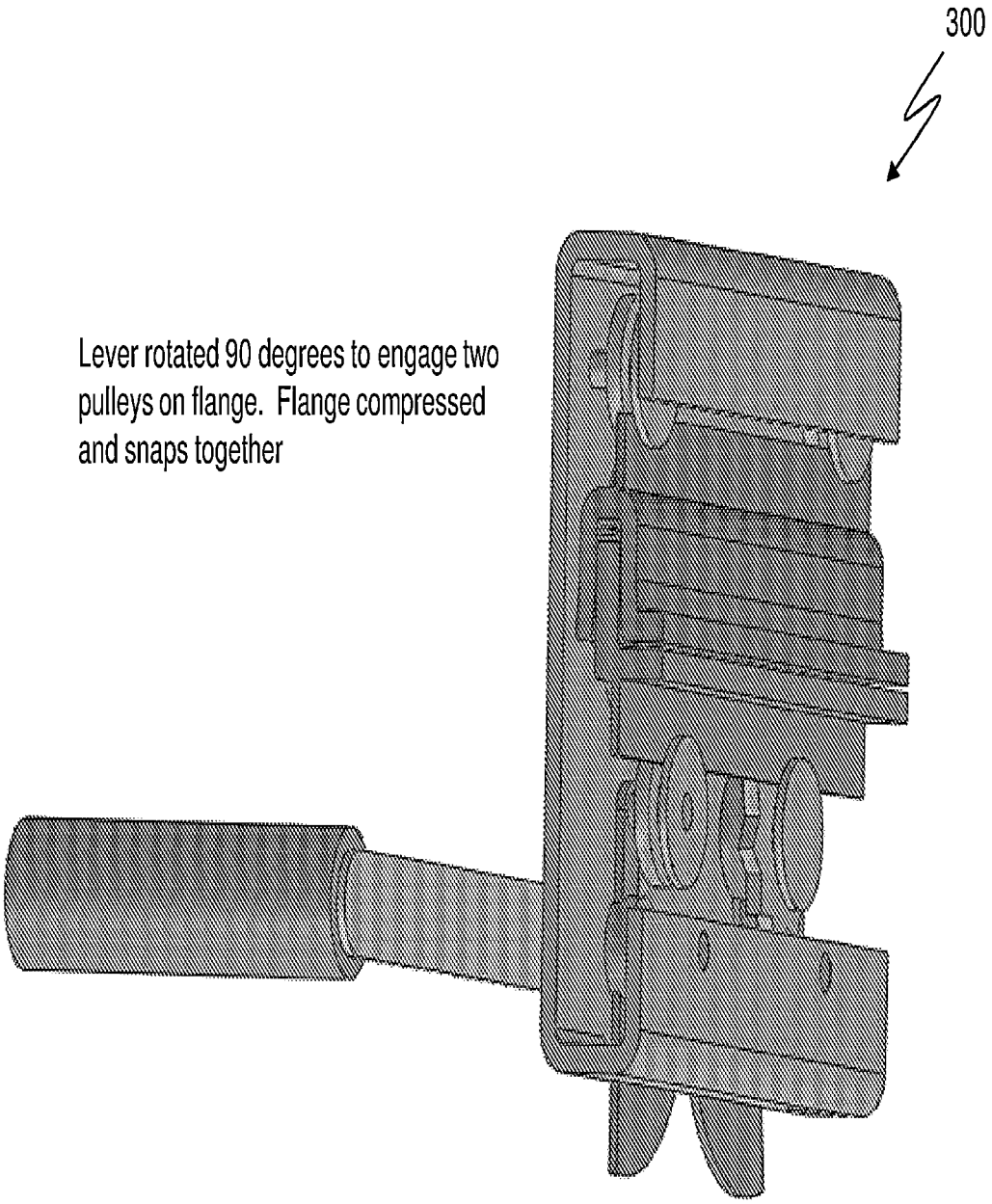
FIG. 13 is a front view of the jig of FIG. 7 associated with a portion of the first and second half tank sections of FIG. 2 with the lower rail system in the engaged configuration, in accordance with one embodiment of the invention.
Figure 14:
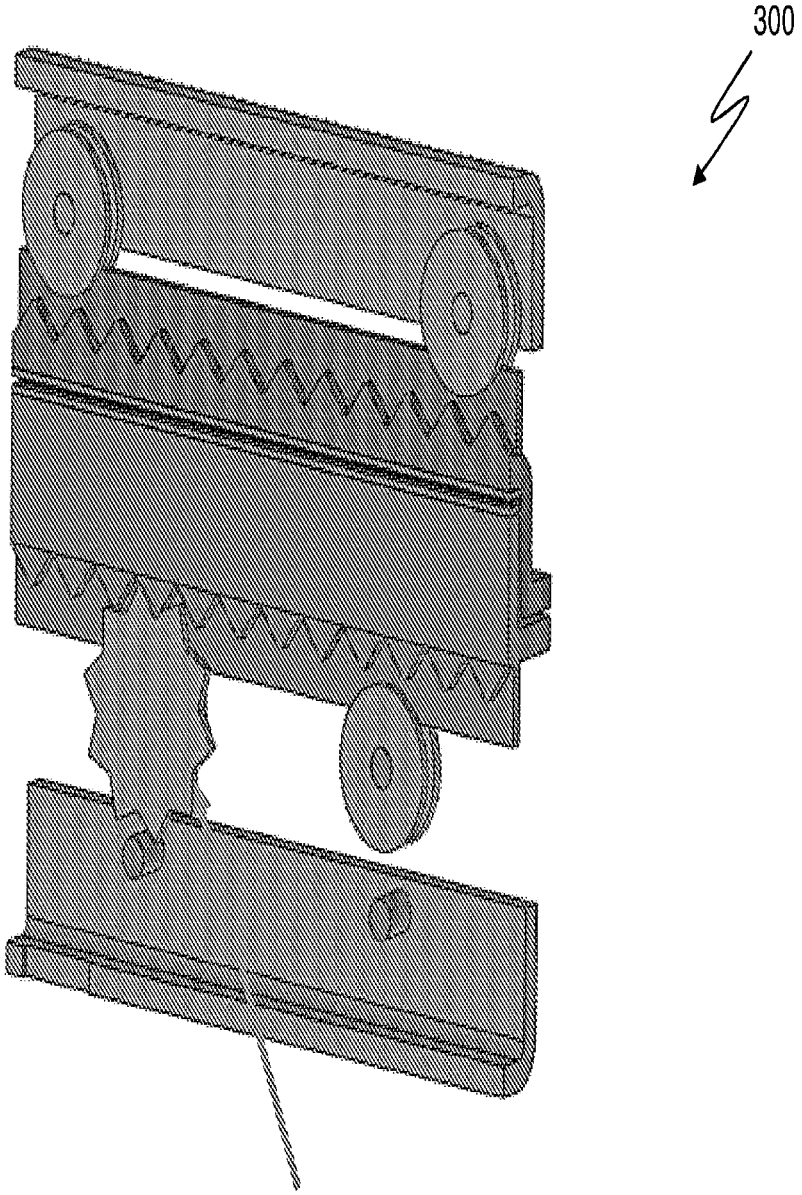
FIG. 14 is a rear sectional view of the jig of FIG. 13 showing the fourth rail roller engaging the second jig structure, in accordance with one embodiment of the invention.
Figure 15:
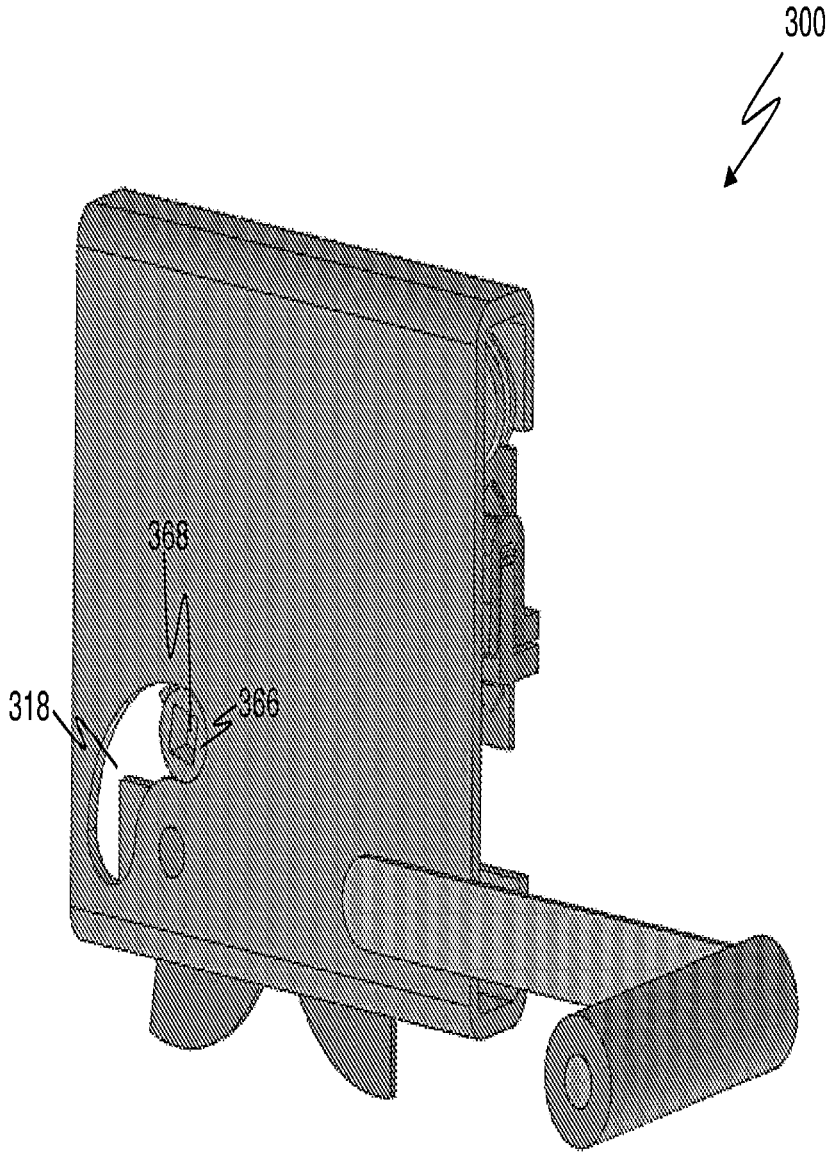
FIG. 15 is a rear view of the jig of FIG. 7 associated with a portion of the first and second half tank sections of FIG. 2 with the handle associated with the rail actuation port to configure the lower rail system into the engaged configuration, in accordance with one embodiment of the invention.
Figure 16:
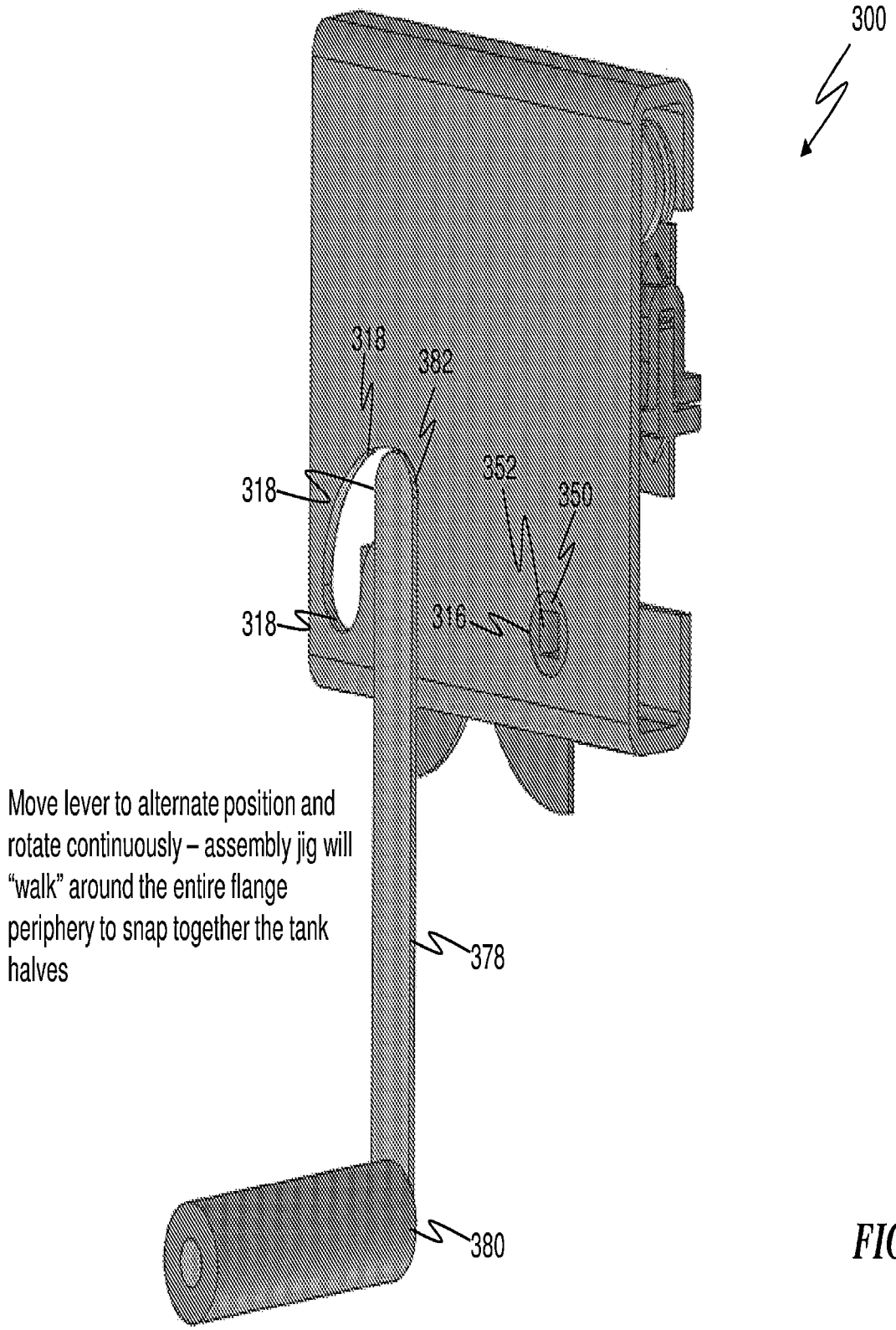
FIG. 16 is a rear view of the jig of FIG. 7 associated with a portion of the first and second half tank sections of FIG. 2 with the handle associated with the roller actuation port to cause the first and second half tank sections to traverse the jig cavity, in accordance with one embodiment of the invention.
Figure 17:
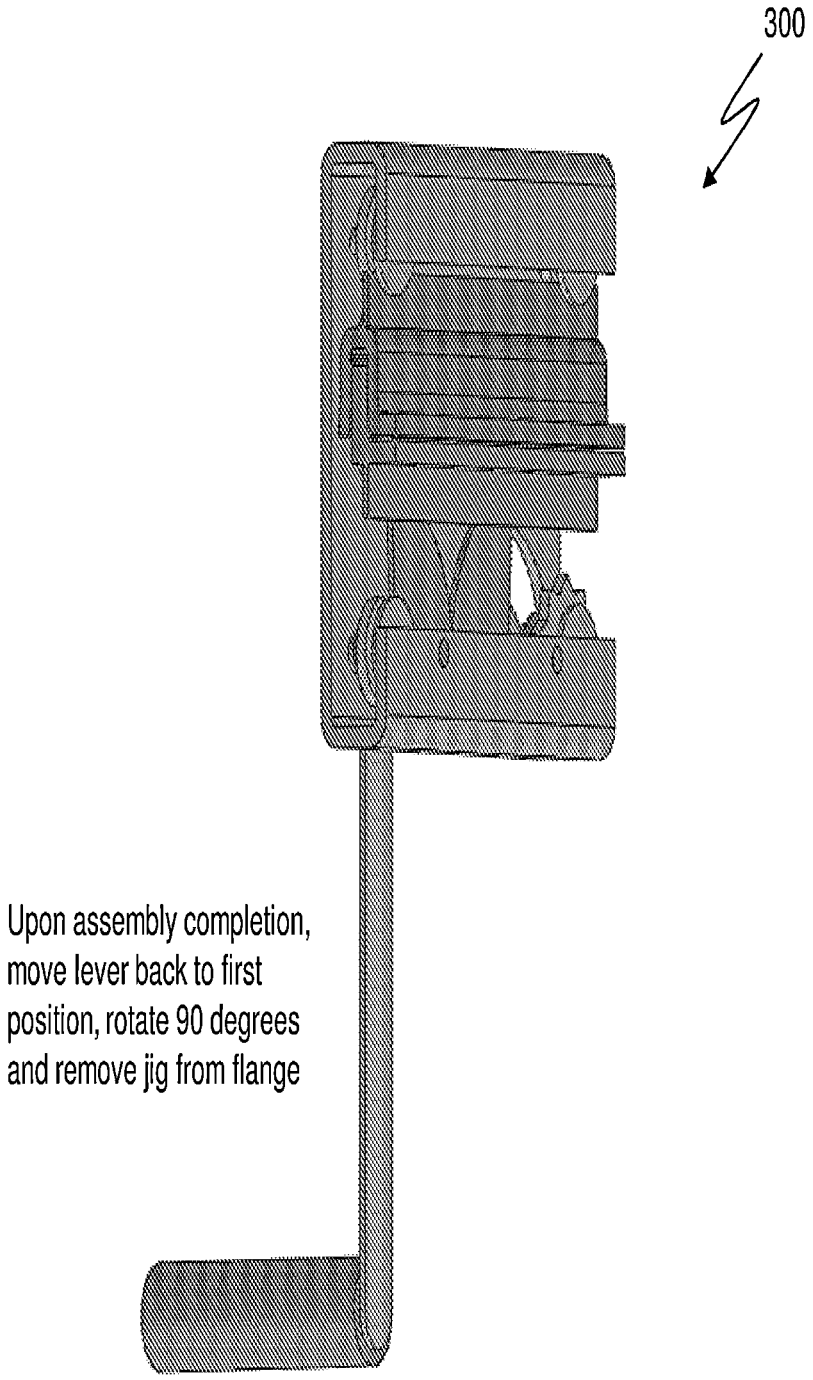
FIG. 17 is a front view of the jig of FIG. 7 associated with a portion of the first and second half tank sections of FIG. 2 following the connection of the first and second half tank sections to allow removal of the first and second half tank sections from the jig cavity, in accordance with one embodiment of the invention.
Figure 18:
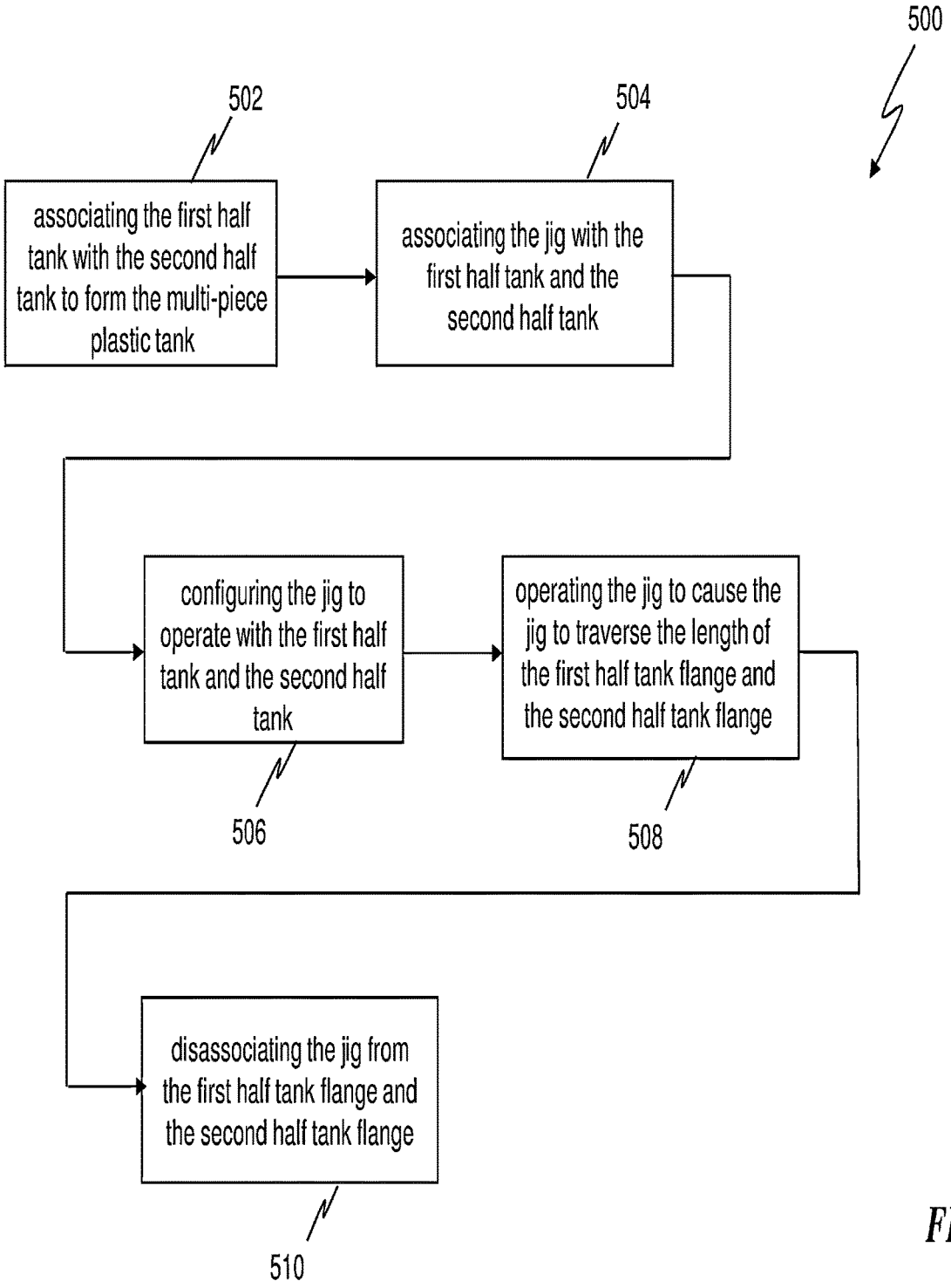
FIG. 18 shows an operational block diagram illustrating a method for associating the first half tank structure with the second half tank structure to form the multi-piece molded plastic tank, in accordance with one embodiment of the invention.

The lower rail system 334 is configured between the disengaged configuration 376 and the engaged configuration 374 as follows. Referring to FIG. 12, the lower rail system 334 is shown in the disengaged configuration 376, wherein the lower rail system 334 is located proximate the containment structure bottom 306 and wherein the fourth rail roller end 366 is located within the jig second cavity 318 proximate to the jig second cavity first end 320. The actuation handle 378 is associated with the first disc shaft end keyed opening 352 and rotated in the clockwise direction approximately 90 degrees, thereby causing the first disc plate 346 to rotate in the clockwise direction about axis W. As the first disc plate 346 rotates, the first plate curved section 348 engages with the second plate curved section 364, thereby causing the second disc plate 362 to rotate in the counterclockwise direction about axis Y. This also causes the fourth rail roller end 366 to move from the jig second cavity first end 320 to the jig second cavity second end 322 within the jig second cavity 318, thereby causing the lower rail system 334 to be configured into the engaged configuration 374, as shown in FIG. 13.

Referring again to FIGS. 9-16, the jig 300 interacts with the first half tank 102 and second half tank 104 as follows. The first half tank 102 and second half tank 104 are associate with each other such that the second flange engagement structure 236 is located proximate the flange cavity 124 and aligned with the flange cavity opening 126. The combination first half tank 102 and second half tank 104 is located within the jig cavity 314, such that the first flange jig structure 120 is located within the first roller channel 330 of the first rail roller 326 and second roller channel 332 of the second rail roller 328. The actuation handle 378 is then associated with the first disc shaft end keyed opening 352 and rotated in the clockwise direction approximately 90 degrees, thereby causing the first disc plate 346 to rotate in the clockwise direction about axis W. This causes the first disc roller arm to rotate about axis W and the second disc roller arm 354 to rotate about axis Y until the second flange jig structure 234 is located within the third roller channel 370 and the fourth roller channel 372 and the lower rail system 334 is configured into the engaged configuration and until the second flange engagement structure 236 becomes securely contained with the flange cavity 124.

It should be appreciated that, the first disc section 336 and the second disc section 338 engage with each other via friction, in accordance with one embodiment of the invention. It should be further appreciated that, in other embodiments, the first plate curved section 348 and the second plate curved section 364 may be configured to include gear teeth, such as, for example, a rack and pinion configuration, to allow the first disc section 336 and the second disc section 338 to engage and cooperate with each other.

The actuation handle 378 is then associated with the fourth rail roller end keyed opening 368 and rotated to cause the fourth rail roller 328 to rotate about fourth roller axis Z. The engagement structure 360 of the fourth rail roller 328 engages the sawtooth shaped portion of the second jig structure 252, thereby causing the combination first half tank 102 and second half tank 104 to traverse the jig cavity 314, thereby causing the jig 300 to 'walk' around the entire flange of the first and second half tanks 102, 104 thereby compressing the first half tank 102 and second half tank 104 together such that the second flange engagement structure 236 becomes securely contained with the flange cavity 124. It should be appreciated that when the second flange engagement structure 236 becomes securely contained with the flange cavity 124, the second flange engagement structure 236 compresses the O-ring 134 thereby creating a seal between the first half tank 102 and second half tank 104.

Once the entire flanges of the first and second half tanks 102, 104 are connected together, the actuation handle 378 is associated with the first disc shaft end keyed opening 352 and the actuation handle 378 is rotated counter-clockwise approximately 90 degrees to configure the lower rail system 324 into the disengaged configuration, thereby allowing the jig 300 to be disassociated from the multi-piece plastic tank 100.

Referring to FIGS. 10-17 and FIG. 18, a method 500 for associating the first half tank structure 102 with the second half tank structure 104 to form the multi-piece molded plastic tank 100 is provided and includes associating the first half tank structure 102 with the second half tank structure 104, as shown in operational block 502. It should be appreciated that the first half tank structure 102 is associated with the second half tank structure 104 such that the first half tank flange 116 is aligned with the second half tank flange 230. Moreover, the sealing article 134 may be associated with the second flange engagement structure 236 and/or the top flange mounting interface cavity 124. One embodiment is shown in FIG. 3. The combination first half tank 102 and second half tank 104 is associated with the jig 300, as shown in operational block 504. This may be accomplished by locating the first half tank 102 and second half tank 104 within the jig cavity 314, such that the first flange jig structure 120 is located within the first roller channel 330 of the first rail roller 326 and second roller channel 332 of the second rail roller 328.

The actuation handle 378 may then be associated with the first disc shaft end keyed opening 352, as shown in operational block 506. This may be accomplished by rotating the actuation handle 378 in the clockwise direction approximately 90 degrees, thereby causing the first disc plate 346 to rotate in the clockwise direction about axis W. As discussed hereinbefore, this causes the first disc roller arm to rotate about axis W and the second disc roller arm 354 to rotate about axis Y until the second flange jig structure 234 is located within the third roller channel 370 and the fourth roller channel 372 and the lower rail system 334 is configured into the engaged configuration and until the second flange engagement structure 236 becomes securely contained with the flange cavity 124. The actuation handle 378 may then associated with the fourth rail roller end keyed opening 368 and rotated to cause the fourth rail roller 328 to rotate about fourth roller axis Z, as shown in operational block 508. This causes the engagement structure 360 of the fourth rail roller 328 to engage the sawtooth shaped portion of the second jig structure 252, thereby causing the combination first half tank 102 and second half tank 104 to traverse the jig cavity 314, thereby causing the jig 300 to 'walk' around the entire flange of the first and second half tanks 102, 104. This advantageously compresses the first half tank 102 and second half tank 104 together such that the second flange engagement structure 236 becomes securely contained within the flange cavity 124.

Once the entire length of the second flange engagement structure 236 becomes securely contained within the flange cavity 124, the jig is disassociated from the first half tank flange 116 and the second half tank flange 230, as shown in operational block 510. This may be accomplished by associating the actuation handle 378 with the first disc shaft end keyed opening 352 and rotating the actuation handle 378 counter-clockwise approximately 90 degrees to configure the lower rail system 324 into the disengaged configuration, thereby allowing the jig 300 to be disassociated from the multi-piece plastic tank 100.

It should be appreciated that, although in one embodiment the fourth rail roller engagement structure 360 and the second jig structure 252 are (substantially a gear/rack and pinion configuration) shown as each having a substantially sawtooth shape to engage with each other, it is contemplated that the fourth rail roller engagement structure 360 and the second jig structure 252 may have different shapes that cooperate to engage with each other, such as triangular shaped, sinusoidal shaped, rectangular shaped, square shaped, etc. Moreover, it should be appreciated that the one or more flange protrusions 132 are shown as protruding from the flange inner sidewalls 130 and the one or more flange side cavities 244 are show as being cavities located within the second flange engagement structure outer sidewall 238. It should be further appreciated that the multi-piece molded plastic tank 100 may be any shape desired suitable to the desired end purpose, such as spherical, cylindrical, rectangular, etc.

It is contemplated that in other embodiments, the one or more flange protrusions 132 may be protruding from the second flange engagement structure outer sidewall 238 and the one or more flange side cavities 244 may be located in the flange inner sidewalls 130. Additionally, in still yet other embodiments, both of these features may be located on both the second flange engagement structure outer sidewall 238 and the flange inner sidewalls 130. Moreover, it should be appreciated that the multi-piece molded plastic tank 100 may be constructed from any material and/or combination of materials suitable to the desired end purpose, such as a composite material, a Polyethylene Terephthalate (PET) material, a Polyethylene (PE) material and a Polypropylene (PP) material.

While the invention has been described with reference to an exemplary embodiment, it should be understood by those skilled in the art that various changes may be made and equivalents may be substituted for elements thereof without departing from the scope of the invention. Moreover, the embodiments or parts of the embodiments may be combined in whole or in part without departing from the scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. A method for associating a jig having a jig engagement structure with a first half tank structure and a second half tank structure to form a multi-piece molded plastic tank, wherein the first half tank structure includes a first half tank flange and wherein the second half tank structure includes a second half tank flange, the method comprising:

associating the first half tank structure with the second half tank structure such that the first half tank flange is aligned with the second half tank flange, wherein at least one of the first half tank flange includes a first jig structure and the second half tank includes a second jig structure;

associating the jig with the first half tank flange and the second half tank flange, such that the jig engagement structure is associated with at least one of the first jig structure and the second jig structure, wherein the jig engagement structure comprises an upper rail system comprising a first rail roller and a second rail roller and a lower rail system comprising a third rail roller and a fourth rail roller;

operating the jig to cause the jig to traverse the first half tank flange and the second half tank flange such that the first half tank flange becomes securely associated with second half tank flange, wherein operating the jig comprises rotating an actuation handle of the jig to cause the fourth rail roller to engage the second jig structure, and the fourth rail roller and the second jig structure each comprise a sawtooth shape; and disassociating the jig from the first half tank flange and the second half tank flange.

2. The method of claim 1, wherein the jig engagement structure comprises:

a containment structure top;

a containment structure bottom;

a containment structure rear;

a containment structure front top lip; and a containment structure front bottom lip.

3. The method of claim 1, wherein associating the jig with the first half tank flange and the second half tank flange further comprises locating the first half tank flange within the first rail roller and the second rail roller.

4. The method of claim 1, wherein the first rail roller is rotatable about a first roller axis and the second rail roller is rotatable about a second roller axis.

5. The method of claim 1, wherein the first rail roller comprises a first roller channel and the second rail roller comprises a second roller channel.

6. The method of claim 1, wherein the lower rail system comprises:

a first disc section, wherein the first disc section comprises the third rail roller, a first disc roller arm, a first disc shaft, and a first disc plate; and a second disc section, wherein the second disc section comprises the fourth rail roller, a second disc roller arm, a second disc shaft, and a second disc plate.

7. The method of claim 6, wherein the third rail roller is rotatably connected to the first disc roller arm to rotate about an axis.

8. The method of claim 6, wherein the fourth rail roller is rotatably connected to the second disc roller arm to rotate about an axis.

9. The method of claim 6, wherein the third rail roller comprises a third roller channel and the fourth rail roller comprises a fourth roller channel.

10. The method of claim 9, wherein the third rail roller is rotatable about a third roller axis and the fourth rail roller is rotatable about a fourth roller axis.

11. The method of claim 9, wherein rotating the actuation handle further comprises rotating the actuation handle of the jig to rotate the third roller channel and the fourth roller channel to engage with the second jig structure.

12. The method of claim 11, further comprising rotating the actuation handle of the jig to rotate the fourth rail roller about an axis.

13. The method of claim 1, wherein disassociating the jig from the first half tank flange and the second half tank flange comprises rotating the actuation handle of the jig counter-clockwise to disengage the lower rail system from the second jig structure.

14. The method of claim 1, further comprising associating a sealing article with the second half tank flange.

* * * * *